United States Patent [19]

Haneda

[11] Patent Number: 4,731,313

[45] Date of Patent: Mar. 15, 1988

[54] APPARATUS FOR FORMING COLOR IMAGES AND METHOD OF USE THEREOF

[75] Inventor: Satoshi Haneda, Hachioji, Japan

[73] Assignee: Konishiroku Photo Industry Co., Ltd., Tokyo, Japan

[21] Appl. No.: 897,781

[22] Filed: Aug. 18, 1986

[30] Foreign Application Priority Data

Aug. 23, 1985 [JP] Japan ..... 60-186437
Oct. 8, 1985 [JP] Japan ..... 60-225641
Oct. 15, 1985 [JP] Japan ..... 60-229524

[51] Int. Cl.[4] ..... G03G 15/01

[52] U.S. Cl. ..... 430/42; 430/54; 355/4

[58] Field of Search ..... 355/4; 430/42, 54, 66

[56] References Cited

U.S. PATENT DOCUMENTS 4,515,462 5/1985 Yoneda ..... 430/42

4,599,285 7/1986 Haneda ..... 430/42

*Primary Examiner*—John L. Goodrow

*Attorney, Agent, or Firm*—Jordan B. Bierman

[57] ABSTRACT

A method and apparatus for forming an image wherein an image exposure is applied onto a photosensitive member having a member provided with a color separation function, a photoconductive layer and an insulating layer, the photosensitive member subjected to the image exposure is treated for flattening surface potential thereon by using a charging device, a whole surface exposure by light of a specific color is applied to the photosensitive member subjected to the flattening treatment thereby to produce a potential pattern on the photosensitive member at a portion corresponding to the color component provided by color separation, and an image exposure is applied onto the photosensitive member having the potential pattern.

6 Claims, 71 Drawing Figures

APPARATUS FOR FORMING COLOR IMAGES AND METHOD OF USE THEREOF

BACKGROUND OF THE INVENTION

1. Field of the Invention

The present invention relates to a method and apparatus for image formation and more particularly to a method and apparatus for forming a multicolor image by electrophotography.

2. Description of the Prior Art

While there have so far been proposed many systems and apparatus for the purpose of providing multicolor images by electrophotography, these are classified broadly into the following groups. One of them is such a system that the operation of forming a latent image and developing the same with color toners on a photosensitive member is repeated for the number of times corresponding to the number of separated colors, and the colors are superimposed on the photosensitive member or transferred to a transfer material each time the development is made and superimposed on the transfer material. The other is such a system that an apparatus having a plurality of photosensitive members corresponding in number to the number of separated colors are used and light images of all the colors are simultaneously exposed on the respective photosensitive members, the latent images formed on the respective photosensitive members are developed by color toners, and these are successively transferred to a transfer material, and thus, the colors are superimposed thereon and a multicolor image is provided.

In the first system, the process of formation of the latent image and development must be repeated for a plurality number of times, and therefore, it is a great disadvantage of this system that it takes a long time for image recording and its speed-up is very difficult. And there is another disadvantage in the case of the system in which the toner images are superimposed on the photosensitive member, because the potential at the portion previously developed with one toner attached thereto is not sufficiently lowered, another toner for the later developed portion is attached to that portion already developed with that toner—where this toner should not be attached to—and therefore, color turbidity is liable to be produced.

In the case of the second system, there is an advantage that high-speed processing is made possible by the parallel use of a plurality of photosensitive members, but since a plurality sets of photosensitive members, optical systems, developing means, and so on are required, this system has a disadvantage that the apparatus becomes complex, larger, and expensive, and so, it is less practical.

And in either of these systems, there is a great disadvantage that it is difficult to register the images at the times of the repeated image formation and transfer, and it is therefore impossible to completely remove the shear in the superimposition of colors.

To thoroughly solve these problems, it is considered to provide a system that will make a multicolor image recorded on a single photosensitive member by one time of image exposure, but a method to effectively achieve such a system is not yet developed at the present time. Specifically, the developing conditions in making development by various colors of toners are not yet investigated, and it is the present situation that disturbance of toner images, insufficiency of image density, and so on cannot be avoided.

To fundamentally solve these problems, the present inventor earlier invented an apparatus capable of forming a multicolor image by one time of image exposure on a photosensitive member. The apparatus, using an electric conductive member, a photoconductive layer, a photosensitive member having a layer including a plurality of different kinds of filters, forms a multicolor image as described below. That is, by applying the surface of the above mentioned photosensitive member with electric charging and an image exposure, an image is formed by charge density on the boundary surface between an insulating layer and the photoconductive layer, then by applying the surface having the image thereon with a uniform exposure of the light of a specific color, a potential pattern is formed on the photosensitive member at the portion of the relative filter, and by developing the potential pattern with a developing device containing a toner of a specific color, a single color toner image is formed. After smoothing the potential, by applying a uniform exposure with the light that is transmitted through the filter portion different from that previously used and by development with another developing device containing a toner of a different color from the previous color, a toner image of the second color is formed on the photosensitive member. Thereafter, the potential smoothing, uniform exposure, and development are repeated for a required number of times. As a result, various colors of toners are attached to various filter portions on the photosensitive member, and thereby, a multicolor image is formed (refer to Japanese Patent Application No. 59-83096). According to this type of multicolor image forming apparatus, the image exposure is made only once, and therefore, there is really no possibility of occurrence of the shear in the different color images.

The present inventor, however, has found after investigations that, although the above mentioned multicolor image forming apparatus solved the problems that the prior art apparatus had, there still remain the following problems.

That is, in the above described apparatus, the image exposure is made from behind the charging device while it is discharging, and therefore there is produced restriction as to the designing of the apparatus. And, since the charging and image exposure are performed simultaneously, electrons or holes must be moved in the surface layer of the photosensitive member in a short time, and so, such a material that will provide a high transfer speed must be used for the photoconductive layer. The photoconductive layers of such inorganic substance as CdS and Se-Te in general provide high transfer speed for the electrons or holes, while speeds provided by the photoconductive layers of organic substance are slower. Thus, selection of materials of the photoconductive layer receives restriction.

On one hand, when an image exposure is applied through a specific filter portion and then a uniform exposure by the specific light is made, the potential produced at the specific filter portion becomes substantially equal to the background potential caused by such as the recharging.

On the other hand, there is a potential rise to be produced at other filter portions due to dark decay of the photosensitive member. Therefore, there occurs such a problem at the time of development being performed under such a condition that the specific filter portion at low potential is developed that the toner is attached also to other filter portions thereby producing color mixing. And, if the developing bias is set to a condition that will not cause the color mixing, only such a copy is obtained that is poor in gradation and full of highlights.

The present inventor has made this invention after strenuous studies to solve the problems still remained unsolved with the multicolor image forming apparatus of the above mentioned Japanese Patent Application No. 59-83096.

As a method to form an image by electrophotography, there is known a method, called the NP method (Japanese Patent Publication No. 42-23910) such that a photosensitive member formed of a photoconductive layer and a transparent insulating layer piled on a conductive substrate is applied with primary charging and the same is then subjected to a charge elimination (a secondary charge) while being applied with an image exposure, whereby a primary latent image is formed by charge distribution while the surface potential on the photosensitive member is made even, and then the same is subjected to a whole surface exposure, and thereby, a potential pattern as a secondary latent image is formed on the surface of the photosensitive member, and this secondary latent image is developed by a toner.

According to the above described method, the image exposure is made from behind the charging device at the time of the secondary charging, and so, the apparatus receives restriction as to its designing. And, since the image exposure and the secondary charging are performed simultaneously and a potential pattern is thereby formed on the surface of the insulating layer, it becomes a requisite for high sensitivity that the electrons or holes produced in the surface layer of the photosensitive member are moved to the substrate in a short time, and therefore such photosensitive materials that will provide high transfer speeds of the utilized electrons or holes must be used. Generally, photoconductive layers of inorganic substance such as CdS and Se-Te provide higher transfer speeds of the electrons or holes, whereas photoconductive layers of organic substance in general provide slower speeds. Thus, selection of the materials for the photoconductive layers receives restriction.

According to the method in which secondary charging is performed subsequent to primary charging and then an image exposure is made (Japanese Patent Laid-open No. 53-76035), the above mentioned problem is solved because the charging and the image exposure is made separately. But, the charges injected to the boundary layer on the insulating layer at the primary and the secondary charging and trapped therein are subject to the electric field opposite to that applied thereto at the time of the injection of the charges. Therefore, when the injected amount of the charges or the trapped amount of the charges suffers a change (for example, the change in the injecting or trapping performance due to a temperature change or aging of the photoconductive layer), the surface potential at the portion subjected to irradiation of the light of the image exposure (the portion will hereinafter be called the white ground portion) becomes unstable. On the other hand, at the portion not subjected to the light of the image exposure (the portion will hereinafter be called the black ground portion), the potential is stabler than the irradiated portion because the portion is controlled to be at a constant surface potential by the secondary charging. Under such conditions, if developing is made to attach a toner to the black ground portion, the toner tends to attach also to the white ground portion where the potential is unstable and thus a fog is produced. Therefore, the combination of the present image forming method and the normal development is liable to be affected by the change in the characteristics of the photosensitive member and is not considered preferable.

SUMMARY OF THE INVENTION

The present invention was made with the above described situations in view, and it is accordingly a primary object of the present invention to provide a method which is capable of forming a plurality of electrostatic latent images for separated colors by one time of image exposure, which therefore does not produce any shear in superimposed colors, not cause the toner for later development to attach the previously developed portion to which one toner is already attached, and is thus capable of forming a multicolor image of high quality through a rapid and simple process.

The above mentioned object of the invention can be achieved by an image forming method comprising the steps of applying an image exposure onto a photosensitive member having a member provided with a color separation function, a photoconductive layer and an insulating layer, giving a treatment to said photosensitive member subjected to the image exposure for flattening surface potential thereon, applying a whole surface exposure by light of a specific color to said photosensitive member subjected to the flattening treatment thereby to produce a potential pattern on said photosensitive member at a portion corresponding to the color component provided by color separation, and applying an image exposure onto the photosensitive member having the potential pattern.

And, the above mentioned object of the invention is achieved by an apparatus for image formation wherein electrostatic latent image forming means and developing means are disposed facing a photosensitive member having a member provided with a color separation function in its surface, a photoconductive layer and an insulating layer, said electrostatic latent image forming means having image exposure means, charging means disposed in a stage succeeding to said image exposure means for flattening a surface potential on said photosensitive member, and exposure means disposed in a stage succeeding to said charging means for applying a whole surface exposure by light of a specific color.

Another object of the present invention is to provide an image forming apparatus which will retain the advantages that the multicolor image forming apparatus described in the above mentioned Japanese Patent Application No. 59-83096 has as they are and will receive no restriction as to selection of materials for photosensitive member and as to design in designing the complex arrangement of the image exposure device and the charging device, and so on.

The above mentioned object of the present invention is achieved by an image forming apparatus comprising primary charging means, secondary charging means, image exposure means, tertiary charging means, and whole surface exposure means by specific color light, which are disposed in succession opposite to a photosensitive member having a surface insulating layer and exhibiting a spectral sensitivity to more than two colors.

A further object of the present invention is to provide an image forming apparatus receiving no restriction as to selection of materials for the photoconductive layer or no restriction as to designing the arrangement of the image exposure device with reference to the secondary charging device, unaffected by temperature changes and aging of the photoconductive layer, and fitted for normal development.

The above mentioned object of the present invention is achieved by an image forming apparatus comprising primary charging means, secondary charging means, image exposure means, tertiary charging means, whole surface exposure means, and developing means for developing an electrostatic latent image formed by the whole surface exposure means, which are disposed in succession opposite to a photosensitive member having a photoconductive layer and an insulating layer.

Other objects and features of the present invention will become more apparent from the description of preferred embodiments thereof in conjunction with the accompanying drawings.

BRIEF DESCRIPTION OF THE DRAWINGS

FIGS. 1 to 19 are for showing a first embodiment of the present invention, wherein:

FIG. 1 is a schematic front view showing the interior of an image forming apparatus;

FIG. 2 is a schematic partial front view showing the interior of another image forming apparatus;

FIGS. 3, 4, 5, 6, 7, 8, 12, and 13 are sectional views of photosensitive members;

FIGS. 9, 10, and 11 are plan views of photosensitive members;

FIGS. 14, 15, and 17 are graphs showing changes in the surface potential on the photosensitive member in an image forming process;

FIGS. 16(*a*) to 16(*i*) are process flow diagrams for explaining an image forming process;

FIG. 18 is a schematic front view showing the interior of another image forming apparatus;

FIG. 19 is a sectional view of a developing device; and

FIGS. 21 to 33 are for showing another embodiment of the present invention, wherein:

FIGS. 21(*a*) to 21(*j*) are process flow diagrams for explaining an image forming process;

FIGS. 22 and 33 are schematic front views showing the interior of an image forming apparatus;

FIG. 23 is a sectional view of a developing device;

FIGS. 24 and 25 are graphs of data obtained in the case where one-component developer was used;

FIG. 26 is a graph showing the relation between amplitude and frequency of a.c. bias in the case where a one-component developer was used;

FIGS. 27 and 28 are graphs of data obtained when a two-component developer was used;

FIG. 29 is a graph showing the relation between amplitude and frequency of a.c. bias in the case where a two-component developer was used;

FIGS. 30 and 31 are graphs showing spectral sensitivities of photoconductive layers; and FIG. 32 is a sectional view of a photosensitive member.

FIGS. 34 to 39 are for showing a further embodiment of the present invention, wherein:

FIG. 34 is a schematic front view showing the interior of an image forming apparatus;

FIG. 35 is a sectional view of a photosensitive member;

FIGS. 36(*a*) to 36(*e*) are drawings schematically showing one example of the process of latent image formation;

FIG. 37(*a*) is a chart showing changes in the potential on the surface of a photosensitive member in correspondence with FIG. 36;

FIG. 37(*b*) is a chart showing changes in the potential on the surface of a photosensitive member; and FIGS. 38(*a*) to 38(*g*) and FIGS. 39(*a*) to 39(*e*) are flow charts showing image forming processes.

DESCRIPTION OF THE PREFERRED EMBODIMENTS

The illustrated examples are all using three kinds of filters, i.e., red, green, and blue filters, transmitting, respectively, red light, green light, and blue light therethrough as a color separation filter (a filter allowing only specific wavelength ranges of light to pass therethrough) and three kinds of color toners corresponding thereto, but the present invention is not limited to such number of combinations of colors.

Figure 1:
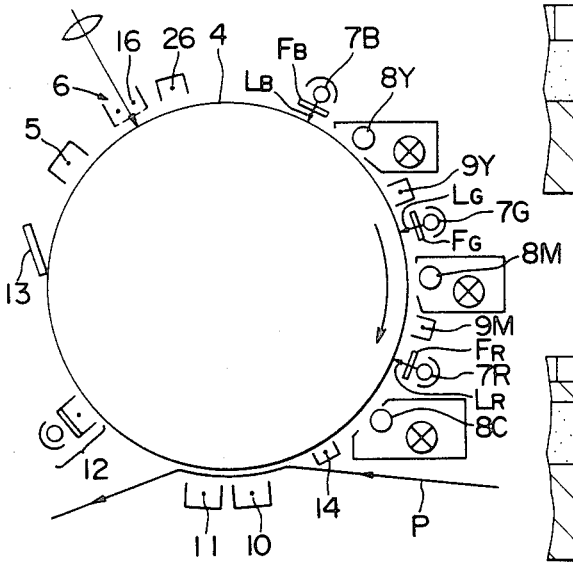
Figure 8:
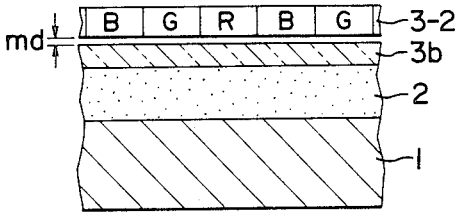
Figure 9:
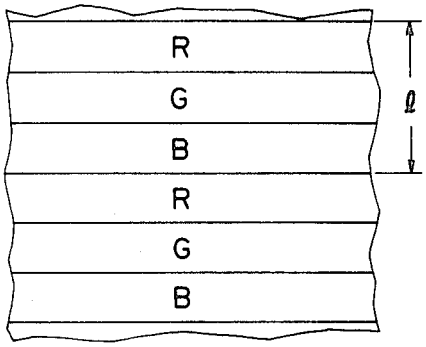
Figure 10:
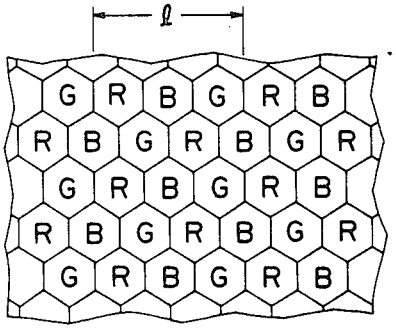
Figure 11:
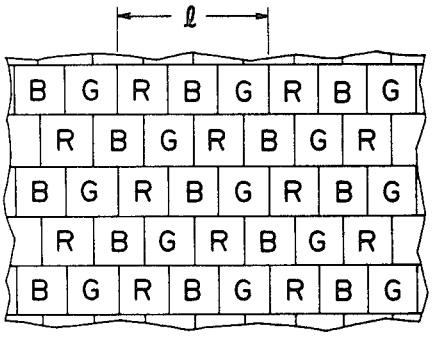
Figure 16:
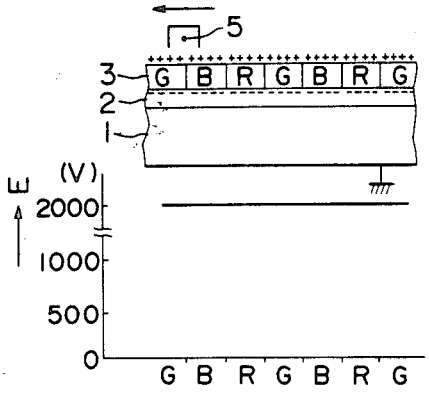
Figure 16:
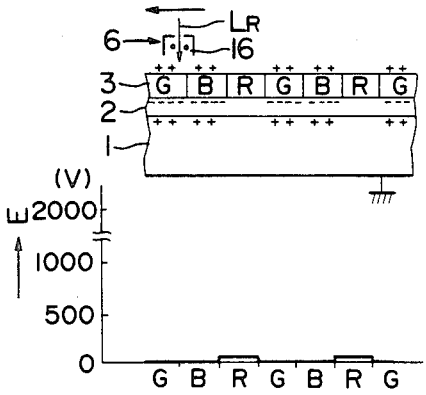
Figure 16:
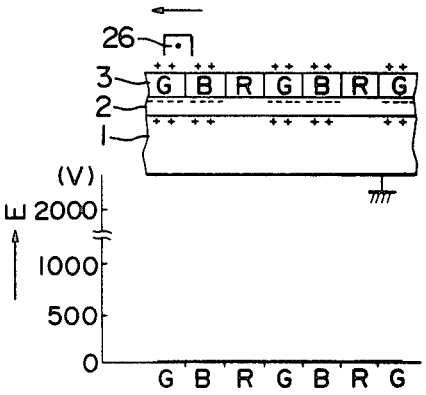
Figure 16:
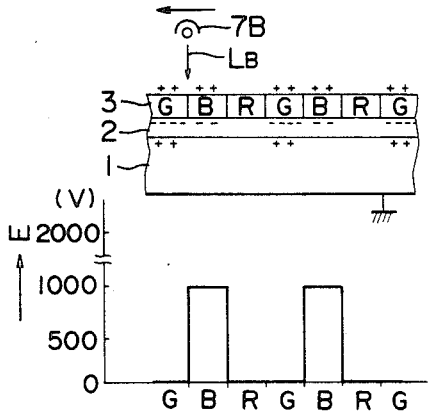
Figure 16:
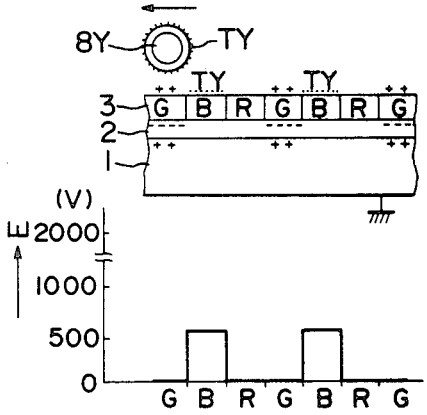
Figure 16:
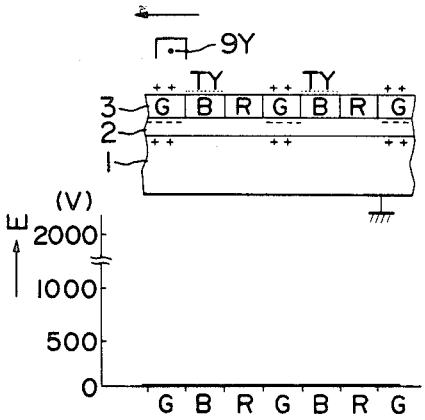
Figure 16:
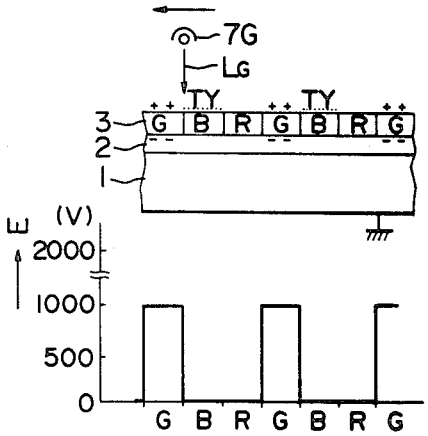
Figure 16:
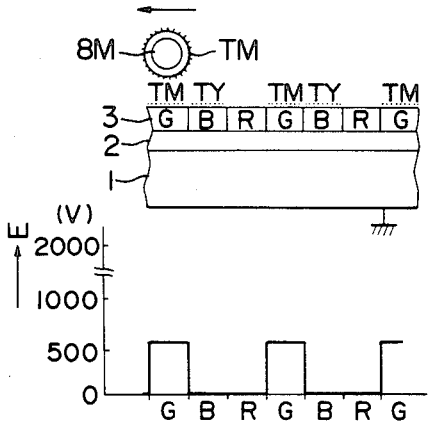
Figure 16:
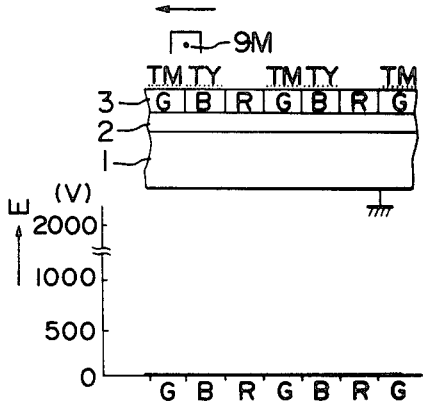
Figure 17:
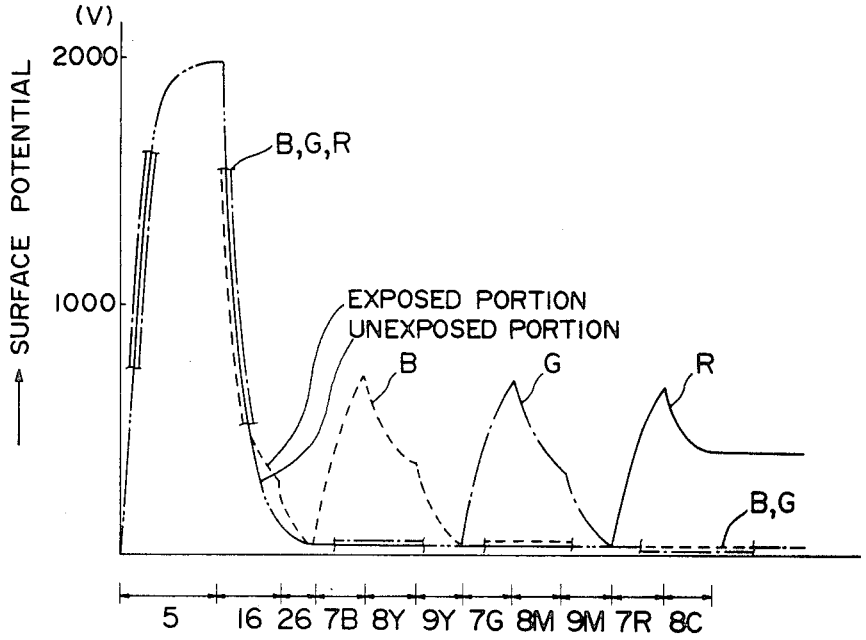

FIGS. 3 to 8, 12, and 13, respectively, are for schematically showing structure of photosensitive members used in the present invention, FIGS. 9 to 11, respectively, are plan views showing examples of filter arrangement in the filter distributed layer within the insulating layer of photosensitive members, FIG. 1 is a schematic structural drawing showing an apparatus for practicing the method of the present invention, FIG. 16 is process flow diagram of the method of the present invention, and FIG. 17 is a graph showing, with the lapse of time, the change of the states of the surface potential on the photosensitive member during the process.

Figure 3:
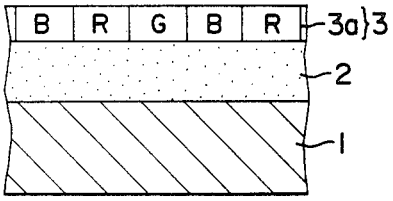
Figure 4:
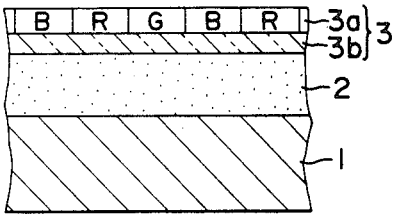
Figure 5:
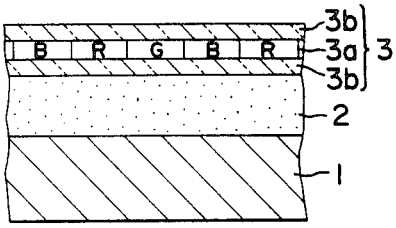
Figure 6:
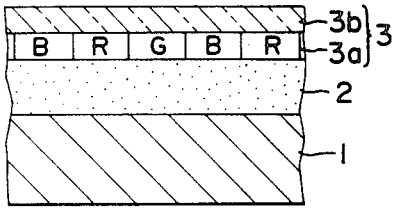
Figure 7:
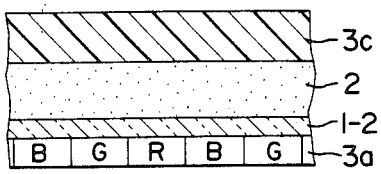

Referring to FIGS. 3 and 6, reference numeral 1 denotes a conductive substrate made of aluminum, iron, nickel, copper, or other metal or their alloy or the like and formed into a cylindrical, endless-belt or other shape and structure, 2 denotes a photoconductive layer or a separated-function type photoconductive layer made up of a charge generation layer and a charge transfer layer, which is constituted of a photoconductive material such as sulfur, selenium, or amorphous silicon, or an alloy containing such elements as sulfur, selenium, tellurium, arsenic, antimony, or the like, an inorganic photoconductive material such as an oxide, iodide, sulfide, selenide, etc. of such metals as zinc, aluminum, antimony, bismuth, cadmium, and molybdenum, or an organic photoconductive material formed from organic photoconductive substance, such as vinyl carbazole, anthoracene phthalocyanine, trinitrofluorenone, polyvinyl carbazole, polyvinyl anthoracene, polyvinylpylene, etc., dispersed in an insulating binder resin such as polyethylene, polyester, polypropylene, polystyrene, polyvinyl chloride, polyvinyl acetate, polycarbonate, acrylic resin, silicone resin, fluorocarbon resin, epoxy resin, etc., and 3 denotes an insulating layer including a distributed layer 3*a* of color separation filter of such colors as red (R), green (G), and blue (B) formed of polymer or resin of various kinds and coloring agents such as dyestuff and pigment. The insulating layer 3 on the photosensitive member of FIG. 3 is formed by attaching insulating materials of resin or the like added with coloring agents to form a color separation filters onto the photoconductive layer 2 in a predetermined pattern by such method as printing, the insulating layer 3 in the photosensitive member of FIG. 4 is formed first by forming a transparent insulating layer 3*b* on the photoconductive layer 2 by a publicly known method and then by attaching coloring agents, colored resin, or the like to the surface thereof in a predetermined pattern by such a method as printing or evaporation, the insulating layer 3 on the photosensitive member of FIG. 5 is formed by further providing a transparent insulating layer 3*b* over the insulating layer 3 on the photosensitive member of FIG. 4 by a method hitherto known publicly, and the insulating layer 3 on the photosensitive member of FIG. 6 is formed by providing a transparent insulating layer 3*b*, like in the formation of the insulating layer 3 of FIG. 5, on what is formed by attaching coloring agents onto a photoconductive layer 2 in a predetermined pattern by such a method as direct printing, evaporation and photoetching, or the like, or on the insulating layer 3 of FIG. 3. The methods for forming the insulating layer 3 are not limited to such as mentioned in the foregoing but an insulating film or sheet including a distributed layer 3*a* of color separation filters may be prepared and the same may be attached or adhered onto a photoconductive layer 3 by a suitable method.

The photosensitive member can also be arranged in the structure as proposed by the present applicant (Japanese Patent Application No. 59-199547). As shown, for example, in FIG. 7, the same is fabricated in a laminated structure with an insulating layer 3*c* disposed on one surface of a photoconductive layer 2 and a light transmitting electric conductive layer 1-2 and an insulating layer 3*a* formed of a color separation filter attached onto the other surface in the mentioned order. The light transmitting electric conductive layer 1-2 is formed, for example, by evaporation of a metal. In the case of the photosensitive member of such a structure, the later discussed charging is made from the side of the insulating layer 3*c*, and the image exposure and whole surface exposure are made from the side of the insulating layer 3*a* formed of the color separation filter.

In the case, for example, of a drum type photosensitive member as shown in FIG. 8, a transparent insulating layer 3*b* may be provided on the photoconductive layer 2, and a layer 3-2 formed of R, G, B filters (a layer similar to the above mentioned layer 3*a*) may be disposed thereover and coaxially therewith, with a minute gap md left therebetween. That is, a cylindrical member 3-2 formed of R, G, B filters is put on the drum-type photosensitive member having no filter, integrally and coaxially therewith, with a minute gap md left therebetween. By virtue of such a structure, any of the filter layers structured as shown in FIGS. 9, 10, and 11 (to be described later in detail) can be selected and exchanged for use. However, in order that the image through the filter cell is not projected extremely blurred on the insulating layer and photoconductive layer, the gap md should not be made so large. And the transparent insulating layer 3*b* and the filter layer 3-2 need not be completely separated but may be in contact with each other.

The distributed layer 3*a* of the color separation filter formed in the insulating layer 3 by attaching coloring agents, colored resin, or the like onto the same are not specifically limited as to the form and arrangement of the minute filters of colors R, G, B, etc. Striped distribution as shown in FIG. 9 is preferable from the point of view of ease in formation of the pattern and mosaic distribution as shown in FIGS. 10 and 11 is preferable in that reproduction of a delicate multicolor image is enabled thereby. The filters of the colors R, G, B, etc. may be arranged in any direction with reference to the extended direction of the photosensitive member, even if they are of striped-distribution, not to mention that of mosaic-distribution. That is, in the case where the photosensitive member is a rotating drum-type photosensitive member, the direction along the length of the stripes may be in parallel with, orthogonal to, or spiral about the axis of the photosensitive member. The kinds of the filter is not limited to that of three colors, R, G, and B, either. It may be of other three colors such as, for example, Y (yellow), M (magenta), and C (cyan), and, in case it is applied not to a full-color but to a two-color reproduction or the like, it may be such a color separation filter in which portions transmitting white color and a specific color (for example, red) therethrough are distributed. As to the individual size of the filters R (red), G (green), B (blue), etc., if it becomes too large, the resolution and color blending characteristic are lowered to degrade the quality of the picture, and if, conversely, the size becomes so small to be equal to or less than the particle size of the toner, a portion of one color tends to be affected by adjoining portions of other colors and also it becomes difficult to form the distributed pattern of filters. Therefore, in the case of distribution of three kinds of filters as shown in the drawings, it is preferable that each set of filters is of a width or size of 30–300 $\mu$m in the length l of each cycle of the cycled distribution. In the case where the number of the kinds of the filters is changed, the preferable range of the above mentioned length l will of course be changed.

It is preferred that each filter is highly resistive. In case where they are of low resistance, gaps are provided therebetween or insulating materials are interposed therebetween so that they are electrically insulated.

Figure 12:
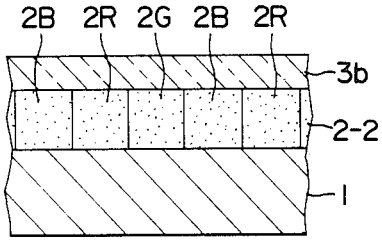
Figure 13:
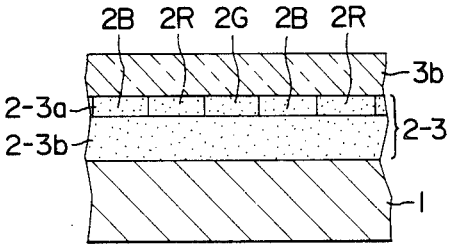

Instead of using the layer 3*a* formed of a color separation filter as described above, a photosensitive member in which a photoconductive layer is provided with a color separation function may be used. FIGS. 12 and 13 show examples of photosensitive members previously proposed by the present applicant (Japanese Patent Application No. 59-201085). The photosensitive member of FIG. 12 is fabricated such that a photoconductive layer 2-2 including a large number of photoconductive portions 2R, 2G, and 2B having necessary spectral sensitivities, or photoconductive portions having sensitivities, for example, to the colors red (R), green (G), and blue (B), is formed on the conductive substrate 1, and a transparent insulating layer 3*b* is provided thereover. The photosensitive member of FIG. 13 is structured such that a charge transfer layer 2-3*b* is formed on the conductive substrate 1, a charge generation layer 2-3*a* made up of portions 2B, 2C, and 2G with different spectral sensitivities is formed thereover, and a transparent insulating layer 3*b* is further provided over the same. In the photosensitive member of FIG. 13, the photoconductive layer 2-3 is made up of the charge generation layer 2-3*a* and the charge transfer layer 2-3*b*. The planar structure of the photoconductive layer 2-2 of FIG. 12 and the charge generation layer 2-3*a* of FIG. 13 may be of the planar structure as shown in FIGS. 9, 10, and 11, like the above described insulating layer formed of the color separation filter.

The image forming apparatus of FIG. 1 is such that uses a photosensitive member (image retainer) 4 of a drum type formed of a photosensitive member as described above and forms a multicolor image according to the method of the present invention. That is, the image retainer 4 rotates in the direction as indicated by the arrow and its surface is charged by a charging device 5 to a uniform potential, and, while electric charging by a charging device 16 which produces an a.c. or d.c. corona discharge of the opposite sign to that of the charging device 5 is applied to the charged surface, beams of white color light scanning an original, reflected or transmitted, are introduced by an image exposure device 6 through a slit of the charging device to irradiate the surface, and thereby image exposing and charging of the opposite polarity to the primary charging are simultaneously performed, and thereupon, the surface potential on the photosensitive member is made even by a charging device 26 similar to the charging device 16. As to this treatment to flatten the surface potential will be described later in detail.

Subsequently, the charged surface is uniformly irradiated by blue light $L_B$ from a color exposure device 7B, whereby an electrostatic latent image providing the above mentioned surface subjected to the image exposure with a complementary color image to blue color is formed. Then, the electrostatic latent image is developed by a developing device 8Y using yellow toner as its developer and the photosensitive member 4 after the development is subjected to discharging by a charging device 9Y producing a similar corona discharge to what is produced by the image exposure device 6, whereby the potential on the image retainer 4 is smoothed. The surface with the potential thereon smoothed is uniformly irradiated by green light $L_G$ from a color exposure device 7G, and thereby, an electrostatic latent image providing a complementary color image to green color is formed thereon, and then the electrostatic latent image is developed by a developing device 8M using magenta toner as its developer, and the image retainer 4 after the development is subjected to corona discharging by a charging device 9M similar to the charging device 9Y, and thereby, the potential on the photosensitive member 4 is smoothed. The surface with the potential thereon smoothed is uniformly irradiated by red light $L_R$ from a color exposure device 7R, and thereby, an electrostatic latent image providing a complementary color image to red color is formed thereon, and then the electrostatic latent image is developed by a developing device 8C using cyan toner as its developer, and thus a multicolor image made up of three-color toner images of yellow, magenta, and cyan are superimposed on the surface of the photosensitive member. The multicolor image after receiving a discharge from a pre-transfer charging device 14 is transferred by a transfer device 10 to recording paper P which is fed in by a paper supply device not shown. The recording paper with the transferred image thereon is separated from the surface of the photosensitive member 4 by a separating device 11, treated by a fixing device not shown for fixing the multicolor image, and discharged from the apparatus. The surface of the photosensitive member 4 from which the multicolor image was transferred is deprived of its electricity by a charge eliminating device 12 making irradiation and discharging and then cleared of residual toner thereon by a cleaning device 13 and returns to the original state ready for formation of another multicolor image.

Figure 20:
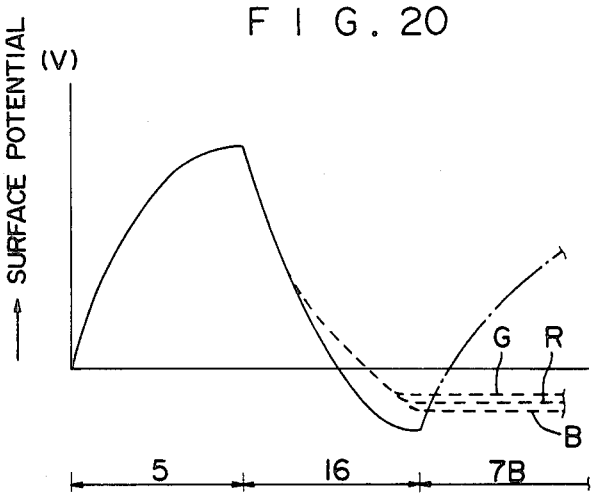
FIG. 20 is a graph showing the change of surface potential of photosensitive member.

Usually, the surface potential on the photosensitive member is not completely flattened by the charging device 16 of the image exposure device 6 as shown in FIG. 20. Referring to the drawing, reference characters given along the abscissa denote the charging devices and the whole-surface exposure device and the ordinate represents the surface potential (relative value) on the photosensitive member.

More particularly, the surface potential at the unexposed portion (the black ground portion or colored portion in the original) by the image exposure is sufficiently lowered as shown by the full line in the drawing, but the same at the exposed portion (white ground portion in the original) is held somewhat higher than the unexposed portion as indicated by the broken line. This phenomenon is considered due to the fact that the surface potential is changed at the exposed portion by transmission of light and release of trapping action of the photoconductive layer, and therefore, the surface potential does not fall although the charging efficiency on the insulating layer is higher than the unexposed portion. The dashed line in the drawing indicates a change in the surface potential at the unexposed portion caused by a whole-surface exposure by the specific color light.

If the surface with the above described surface potential difference between the exposed portion and the unexposed portion as it is is subjected to the succeeding whole surface exposure by the specific color light for forming a latent image formation is made on, since there is present a potential pattern as indicated in FIG. 20, the toner attaches not only to the portion to which the toner should attach but also to other portion at the time of development, and as a result, color turbidity is produced on the obtained picture image.

Such a phenomenon does not become any trouble with a monochromatic image forming apparatus provided with a transparent insulating layer in the surface layer since the image formation is performed only by distinction between the exposed portion and the unexposed portion. In case of full-color image formation, however, there are exposed portion and unexposed portion for each filter, and that, the surface potential levels are a little different depending upon kinds of the filters (B, G, R) (refer to FIG. 20), color turbidity is produced by the above described unwanted attaching of toner.

Figure 14:
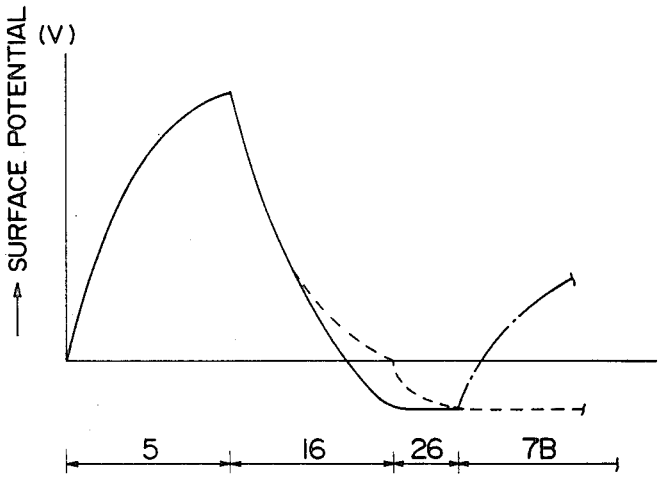
Figure 15:
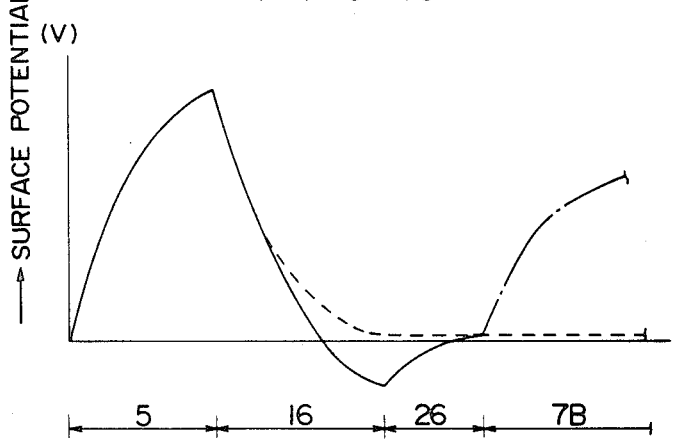

The charging device 26 is provided to eliminate incomplete flatness of the surface potential produced by the charging device 16 and to completely flatten the surface potential as shown in FIGS. 14 and 15. FIG. 14 shows the case where the potential at the exposed portion was brought to the level at the unexposed portion, while FIG. 15 shows the case where the potential at the unexposed portion was brought to the exposed portion, to achieve the flattening.

Figure 2:
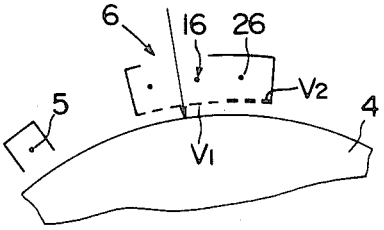

The charging device 26 may be a corona discharging device of a corotron or scorotron for a d.c. corona of like or unlike polarity to that of the charging device 16 or an a.c. corona. And, the charging device 26 may be made integral with the image exposure device 6, disposed adjoining the charging device 16 in the rear stage thereof as shown in FIG. 2. In this arrangement, the grid is divided into two for controlling the flattened potential and voltages $V_1$ and $V_2$ are applied thereto. The voltage $V_2$ for the flattening region may preferably be made equal to the voltage $V_1$ or adjusted so that the charges for the latent image (unevenness in the surface potential) may be eliminated.

Each step in the above described multicolor image formation process performed by the apparatus of FIG. 1 will further be described with reference to FIG. 16 in the following. Incidentally, FIG. 16 shows the case where a photoconductive material of an n-type semiconductor such as cadmium sulfide is used for the photoconductive layer 2 of the photosensitive member 4, and reference numerals in FIG. 16 identical to those in FIGS. 1 to 11 denote members performing identical functions.

FIG. 16(*a*) shows the state of the rotating photosensitive member 4 uniformly charged by a positive corona discharge produced by the charging device 5. There are produced positive electric charges on the surface of the insulating layer 3, and responding to that, there are induced negative charges on the boundary layer between the photoconductive layer 2 and the insulating layer 3, and as a result, the electric potential on the surface of the photosensitive member 4 indicates uniform potential as shown in the graph of potential E.

FIG. 16(*b*) shows the state of the above mentioned charged surface which has been subjected to an image exposure by the image exposure device 6. The drawing shows, as an example, a change in the charged surface at the portion irradiated by the red color component $L_R$. Since the red color component $L_R$ is transmitted through the R filter portion of the insulating layer 3 and renders the portion of the photoconductive layer 2 thereunder conductive, the charges on the surface of the insulating layer 3 and the negative charges on the boundary layer between the photoconductive layer 2 and the insulating layer 3 at that portion are erased by action of the charging device 16. Further, the potential pattern is sufficiently smoothed by the charging device 26. On the other hand, since the red color component $L_R$ is not transmitted through the G and B filter portions, the negative charges on the photoconductive layer 2 at these portions remain intact. Similar things hold for other color components of the image exposure. Thus, on the boundary layer between the insulating layer 3 and the photoconductive layer 2 is formed a latent image of charge density corresponding to each color component transmitted through each filter. However, by action of the charging device 16 of the image exposure device 6 and the charging device 26, the potential on the suface of the photosensitive member is made even as seen from the graph showing the potential E regardless of the amounts of the electric charges on the boundary layer between the insulating layer 3 and the photoconductive layer 2, or, in other words, whether irradiated by the image exposure or not. Similar results are obtained for the green color component and the blue color component of the image exposure, and the state in which these results are accumulated is brought about as a consequence of the image exposure performed by the image exposure device 6, but from the state as it is, no function as an electrostatic image is provided.

In the case where the charging device 26 is not applied to the surface, the surface potential at the R filter portion is held somewhat higher than that at the G and B filter portions.

If a discharging treatment by the charging device 26 is applied to the surface in the above described state as shown in FIG. 16(*c*), the surface potential at the R filter portion is lowered by this discharging substantially to the zero level equal to the G and B filter portions, and thus, the surface potential for all the filter portions become completely even.

Although it is omitted and not shown in FIG. 16, like results are obtained for the green component and the blue component of the image exposure, and the state in which these results are accumulated is produced by the image exposure by the image exposure device 6 and the discharging by the charging device 26. This state is that in which a primary latent image—not working as an electrostatic image—is formed.

FIG. 16(*d*) shows the state of the above described surface undergone the image exposure, which has been subjected to a uniform exposure of blue light $L_B$ provided by the color exposure device 7B. Since the blue light $L_B$ is not transmitted through the R and G filter portions, these portions suffer no change, but since it passes through the B filter portion, the portion of the photoconductive layer 2 thereunder is rendered conductive, whereby the electric charges present upper and lower boundary layers of the photoconductive layer 2 are neutralized and, as a result, there appears a potential pattern giving a complementary color image to the color B formed by the previous image exposure at the B filter portion on the surface of the insulating layer 3, as indicated in the graph of the potential E.

FIG. 16(*e*) shows the state of the electrostatic latent image earlier formed by the whole-surface exposure by the blue light $L_B$ now developed by the developing device 8Y using as its developer negatively charged yellow toner $T_Y$ of the complementary color to the color B. The yellow toner $T_Y$ attaches only to the B filter portion showing some potential and does not attach to the R and G filter portions showing no potential. Thus, a toner image of yellow color as one of the separated colors is formed on the surface of the photosensitive member 4. The potential at the B filter portion is lowered by the attaching thereto of the yellow toner but still held at a certain level as shown in the graph of the potential E, and therefore, it sometimes occurs that other toner attaches to this portion in the following development thereby causing color turbidity.

FIG. 16(*f*) shows the state of the surface of the photosensitive member 4 earlier developed by the developing device 8Y now subjected to a corona discharge produced by the charging device 9Y in order to prevent other toner from attaching to the B filter portion. This discharging made by the charging device 9Y, different from the strong discharging made by the charging device 5, have almost no effect on the R and G filter portions, but mainly lowers the potential at the B filter portion to which the yellow toner $T_Y$ is attached. And therefore, the surface potential becomes uniformly to indicate zero as shown in the graph of the potential E. Thereby, it is prevented for other toner to attach to the B filter portion where the yellow toner $T_Y$ is attached and occurrence of the color turbidity is thus prevented.

Subsequently, the surface of the photosensitive member 4 with the yellow toner image formed thereon of FIG. 16(*f*) is subjected to a whole surface exposure by green light $L_G$ from a color exposure device 7G, and thereby, the same as described with reference to FIG. 16(*d*), an image potential appears now on the G filter portion. If this electrostatic latent image is developed by a developing device 8M using magenta toner as its developer, the magenta toner attaches only to the G filter portion and a magenta toner image is formed like the case of FIG. 16(*e*). Thus, toner images of two colors are superimposed in substance. This surface with the image formed thereon is also subjected to a corona discharge produced by a charging device 9M, and thereby, the potential at the G filter portion to which the magenta toner is attached is lowered so that other toner may be prevented from attaching thereto. These steps are shown in FIGS. 16(*g*), (*h*), and (*i*).

In succession, if the surface of the photosensitive member 4 with the two-color toner image formed thereon is subjected to a whole surface exposure by red light $L_R$ by a color light exposure device 7R, since there does not appear any image potential at the R filter portion this time, the electrostatic latent image is not developed by a developing device 8C using cyan toner as its developer, and any cyan toner is not formed. Consequently, a red color image formed of yellow and magenta which has no shear in superimposed colors and no color turbidity is formed on the image retainer 4.

Incidentally, FIG. 16 showed the example in which the photoconductive layer 2 of the photosensitive member 4 is formed of the n-type photo-semiconductor, but it is of course possible to use the p-type photo-semiconductor, instead, such as selenium for the photoconductive layer 2, in which case positive and negative signs of the electric charges are all reversed, but the fundamental process in essence is quite the same. And, in the case where the injection of electric charges by the charging device 5 into the photosensitive member 4 is difficult, uniform irradiation of light may be used concurrently. Although the surface potential on the photosensitive member 4 after charging in FIG. 16(*c*) was made substantially to zero, it maay be slightly biased positively or negatively.

The relation between the colors and the steps of the image formation by toners of three primary colors by the above described three-separated-color method is shown in Table 1 below. Referring to Table 1, symbol "◌" indicates the primary latent image, symbol "○" indicates the electrostatic latent image, and symbol "◍" indicates the toner image. And, symbol "↓" means that the state shown in the column just above is still maintained, and the blank column indicates absence of an image. Further, symbol "—" in the column "Attached Toner" indicates that no toner is attached and Y, M, C indicates that yellow toner, magenta toner, and cyan toner are attached respectively.

between the whole-surface exposure and the development are left out.)

Figure 18:
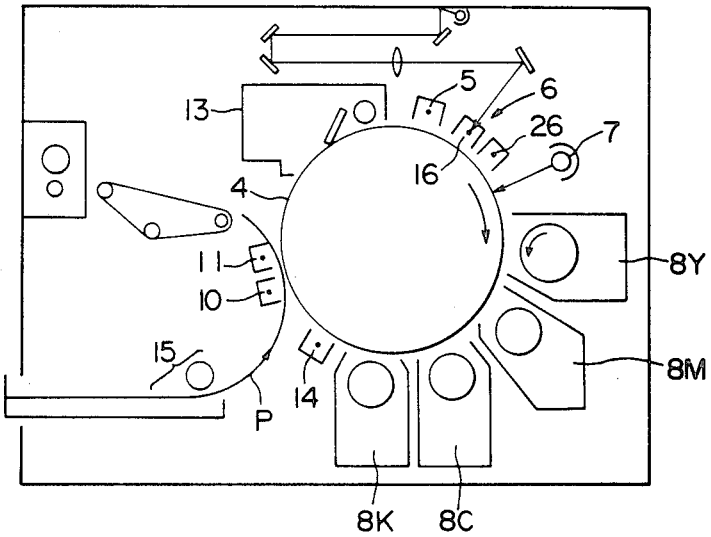

The multicolor image forming apparatus of FIG. 18 is such that is adapted to form a toner image of one color for one rotation of the photosensitive member 4, and it is different from that of FIG. 1 in that the whole surface exposure is made by a lamp device provided with blue, green, red, and infrared lights which can be used being switched from one to another or simultaneously and the surface potential on the photosensitive member 4 is flattened, after the development, utilizing the charging device 16 of the image exposure device 6 or the charging device 26. Also in this multicolor image forming apparatus, the image forming operations as described with reference to FIG. 16 are performed, and thereby, a multicolor image free from shear in colors and a monochromatic image with good image density and resolution can be formed. More particularly, when a trichromatic image is to be formed, the photosensitive member 4 is charged by the charging device 5 and the image exposure is made through the charging device 16, and then, after the surface potential has been made even by the charging device 26, the surface of the photosensitive member 4 is subjected to the whole surface exposure by blue light of the lamp 7, and the thus formed potential pattern is developed by the developing device 8Y and an yellow toner image is formed. The toner image passes by the developing devices 8M, 8C, and 8K, pre-transfer charging device 14, transfer device 10, separating device 11, cleaning device 13, and the charging device 5 without being affected thereby. When the photosensitive member 4 has reached the position of the charging device 16 or 26, it receives a corona discharge therefrom so that its surface potential is made even, and then it receives the whole surface exposure of green light and a potential pattern is formed thereon. Subsequently, this potential pattern is developed by the developing device 8M and thereby a magenta toner image is formed. In like manner, formation of a potential pattern

TABLE 1

| Original | White | | | Red | | | Green | | | Blue | | | yellow | | | Magenta | | | Cyan | | | Black | | |
|---|---|---|---|---|---|---|---|---|---|---|---|---|---|---|---|---|---|---|---|---|---|---|---|---|
| Filter Distributed | R | G | B | R | G | B | R | G | B | R | G | B | R | G | B | R | G | B | R | G | B | R | G | B |
| Layer 3a | | | | | ◌ | ◌ | ◌ | | ◌ | ◌ | ◌ | | | | ◌ | | ◌ | | ◌ | | | ◌ | ◌ | ◌ |
| Image Exposure | | | | | | | | | | | | | | | | | | | | | | | | |
| Blue Whole Surface | | | | | ↓ | ○ | ↓ | | ○ | ↓ | ↓ | | | | ○ | | ↓ | | ↓ | | | ↓ | ↓ | ○ |
| Exposure | | | | | | ◍ | | | ◍ | | | | | | ◍ | | | | | | | | | ◍ |
| Yellow Development | | | | | ↓ | | ↓ | | | ↓ | ↓ | | | | | | ↓ | | ↓ | | | ↓ | ↓ | |
| Green Whole Surface | | | | | | | ↓ | | | ↓ | ○ | | | | | | | | ↓ | | | ↓ | ○ | |
| Exposure | | | | | ○ | | | | | | | | | | | | ○ | | | | | | | |
| Magenta Development | | | | | ◍ | | ↓ | | | ↓ | ◍ | | | | | | ◍ | | ↓ | | | ↓ | ◍ | |
| Red Whole Surface | | | | | | | | ○ | | | | | | | | | | | | ○ | | | | |
| Exposure | | | | | | | | | | ○ | | | | | | | | | | | | ○ | | |
| Cyan Development | | | | | | | | ◍ | | ◍ | | | | | | | | | | ◍ | | ◍ | | |
| Attached Toner | — | — | — | — | M | Y | C | — | Y | C | M | — | — | — | Y | — | M | — | C | — | — | C | M | Y |
| Reproduction | | White | | | Red | | | Green | | | Blue | | | Yellow | | | Magenta | | | Cyan | | | Black | |

FIG. 17 indicates changes in the surface potential on the B, G, R filter portions of the photosensitive member during the above described image forming process. In the graph, each of the portions 5, 16, 26, 7B, 8Y, 9Y, 7G, 8M, 9M, 7R, and 8C along the abscissa indicates the period during which the member corresponding to the mentioned reference character in FIG. 1 or 16 is in a step to act upon the photosensitive member 4, and B, G, and R indicates maximum, or minimum, potential at each filter portion. (In the above indication of elapse of time during the process, such periods of time between the primary charging and the secondary charging and by red color light and development by the developing device 8C are performed. If a thicker image is desired, the photosensitive member 4 after the potential has been smoothed is further subjected to irradiation by white color or infrared light from the whole surface exposure means 7 and the thus formed potential pattern is developed by developing device 8K, and thus, a color toner image added with black toner is obtained.

The present multicolor image forming apparatus is structured substantially as simple as a monochromatic copying machine excepting for the increased number of the developing devices, and so, it has an advantage that it can be provided in smaller size and at lower cost.

Identical reference characters in FIG. 18 to those in FIG. 1 denote members performing identical functions.

Figure 19:
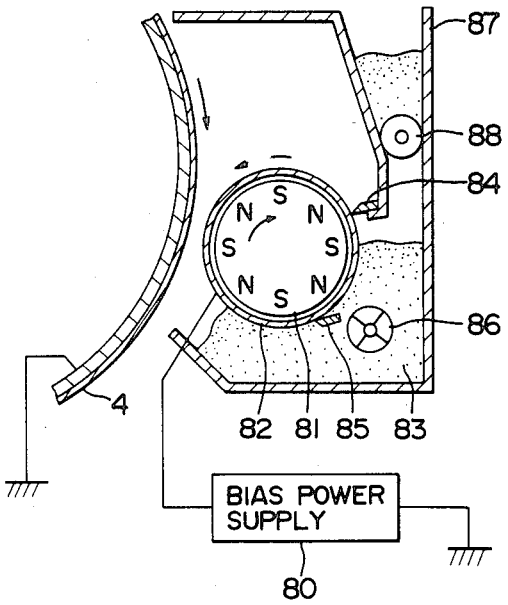

As the developing device 8Y-8K to be used for multicolor image forming apparatus as shown in FIG. 1 or FIG. 18, a magnet brush developing device as shown in FIG. 19 is favorably used.

The developing device of FIG. 19 is adapted such that at least either a developing sleeve 81 or a magnet member 82 provided with N and S poles disposed on the peripheral surface within the developing sleeve 81 is rotated, whereby the developer attracted by magnetic force of the magnet member 82 from a developer reservoir 83 onto the surface of the developing sleeve 81 is transferred in the direction indicated by the arrow. Midway through the transfer of the developer, the transferred amount thereof is regulated by a layer thickness regulating blade 84, whereby a developer layer is formed, and this developer layer develops the photosensitive member 4 according to the potential pattern formed thereon in the developing region where the developing sleeve opposes the photosensitive member 4. At the time of the developing, the developing sleeve 81 is applied with a developing bias voltage from a bias power source 80. According to the need, the bias voltage may be applied to the developing sleeve 81 even when developing is not made, to prevent transfer of toner from the developing sleeve 81 to the photosensitive member 4 or from the photosensitive member 4 back to the developing sleeve 81. Or, at the off-development period, the a.c. bias component applied when the developing is performed (at the on-development period) may be cut off and only a d.c. bias component may be applied to the developing sleeve, the same may be put in a floating state or grounded, or a d.c. bias of like polarity to that of the toner may be applied, or the developing device may be separated from the image retainer, or some of these measures may be used concurrently. Reference numeral 85 denotes a cleaning blade for scraping the developer layer off the developing sleeve 81 which has passed the developing region to return the same to the developer reservoir 83, 86 denotes stirring means for stirring and uniformalizing the developer as well as producing frictional electricity on the toner particles, 88 denotes a supply roller for supplying the toner from a toner hopper 87 to the developer reservoir 83.

The developer used in such a developing device may be that constituted only of a toner, so-called one-component developer, or that constituted of a toner and a magnetic carrier, so-called two-component developer. In the developing, the method making the developer layer, i.e., a magnetic brush, directly slide along the surface of the photosensitive member may be used, but, in order that the formed toner image may not be injured, it is preferable specifically at the second and later developing to use such a method that the developer layer is kept out of contact with the photosensitive member such as, for example, described in specifications of U.S. Pat. No. 3,893,418 and Japanese Patent Laid-open No. 55-18656, and, in particular, of Japanese Patent Application Nos. 58-57446, 58-238295, and 58-238296. These methods are such that use one-component or two-component developer including a non-magnetic toner of which coloring can be freely chosen and makes the developing by means of alternating electric field produced within the developing region with the electrostatic image retaining member and the developer layer kept out of contact. The non-contact developing is performed with the distance between the developing sleeve and the photosensitive member made larger than the thickness of the developer layer (while they are kept at equal potential level) and under those various conditions as described above.

As the color toners for use in the developing, those for developing electrostatic images produced by known art can be used which are constituted of known binding resin in use for ordinary toner, coloring agent such as organic or inorganic pigment or dyestuff of various chromatic and achromatic colors, various magnetic additives, and the like, and as the carriers, various known carriers generally used for electrostatic images such as magnetic carriers of iron powder, ferrite powder, such powder coated by resin, magnetic material dispersed in resin, and the like can be used.

And, the developing method as described in Japanese Patent Application Nos. 58-249669 and 58-240066 earlier applied by the present applicant may be used.

In the present invention, as the charging device for making a charging treatment each time, in the second time and thereafter, prior to the whole surface exposure on the surface where development has just been made, a charging device for making biased or unbiased a.c. corona charging or a d.c. charging device is used. In case where the d.c. charging device is used, in particular, a scorotron charging device having a grid capable of controlling charging potential is preferably used to a corotron charging device having only a charging wire, and it is desirable that the charging potential is made virtually equal to that existing when the step of the simultaneous secondary charging and image exposure was finished. For example, if the potential when the simultaneous secondary charging and exposure step was finished was 0 V and the potential at the portion to which the toner was attached was biased toward the positive side, it is preferred to make the potential of the grid of the scorotron approximately 0 V (for example, to ground the same) and apply a negative voltage to the charging wire.

As to the effect of the above mentioned charging treatment, description has already been made. In addition to the effect that the residual potential at the portion to which a toner was attached at previous development is sufficiently lowered so that another toner is prevented from attaching to the same portion, such effects are also obtained that the potential on the surface of the photosensitive member is prevented from rising due to the dark decay of the potential in the photoconductive layer, and that the toner is provided with sufficient charge amount enabling the toner image to be satisfactorily transferred later on. In this connection, for the sake of comparison with the embodiment of the present invention described with reference to FIGS. 1 and 18, trichromatic image formation was made under the same conditions except that the charging devices 9Y and 9M just in the succeeding stage to the developing devices 8Y and 8M were left out. The resultant recorded image was of poor hue and greatly inferior to the original image. On the other hand, in the case the reproduction was made in accordance with the above mentioned embodiment of the present invention, the recorded image obtained was of virtually of the same hue and distinct coloring as that of the original picture, and what is more, such an effect was obtained that the yield rate of the transfer of the toner was higher and the quantity of the toner recovered to the cleaning device 13 was smaller.

As apparent from these, the charging treatment practiced immediately after the development is very important process to obtain a nice multicolor image.

Concretely, in the image forming apparatus of FIG. 1, the photosensitive member 4 was provided by the photosensitive member of a laminated structure as shown in FIG. 6 having a photoconductive layer 2 of CdS of a thickness of 30 μm and an insulating layer 3 of a thickness of 20 μm including a filter layer 3a of the R, G, and B filter distribution of FIG. 10 in which the length l was 100 μm, and the photosensitive member 4 was adapted to be 120 mm in diameter and rotated in the direction as indicated by the arrow at the surface speed of 200 mm/sec. The charging device 5 was provided by a corotron charging device bringing the surface potential of the photosensitive member 4 to the level of 1.5 KV after the charging, the charging device 16 of the image exposure device 6 was provided by a scorotron charging device, and succeeding to the charging thereof, the scorotron charging device 26 provided in parallel therewith was adapted to smooth the surface potential of the photosensitive member 4 at the level of −50 V. Each of the developing devices 8Y-8C was a magnet brush developing device that was formed of a developing sleeve of non-magnetic stainless steel the outer diameter thereof being 25 mm, which was adapted to be rotated counterclockwise at the speed of 100 rpm, and an internal magnet member having eight magnetic poles on the periphery thereof for providing the surface of the developing sleeve with a maximum magnetic flux density of 800 G, which was adapted to be rotated clockwise at the speed of 800 rpm to transfer a developer layer formed thereon. The distance between the photosensitive member 4 and each of the developing devices 8Y-8C was kept at 1 mm. The developing devices 8Y-8C used developer of a mixture of toner and carrier in the ratio of 1:4 by weight, the toner being of yellow, magenta, and cyan colors, respectively, of 10 μm in average particle size, and of −10 to −20 μC/g in frictional electricity amount and the carrier being 25 μm in average particle size and made from resin containing magnetic material of specific resistance of 10⁻Ωcm or higher dispersed therein. The thickness of the developer layer formed on the developing sleeve of each of the developing devices 8Y-8C was regulated to be 0.8 mm and it was adapted, during the developing operation of each of the developing devices 8Y-8C, such that the developing sleeve was applied with developing bias provided by superimposing a d.c. voltage of +50 V on an a.c. voltage of the effective value of 1 KV and at the frequency of 2 KHz. The smoothing by the charging devices 9Y and 9M were performed under the conditions, for the first example, applying the back plate with a d.c. voltage of −50 V and applying the charging device with an a.c. voltage of 6 KV, and for the second example, grounding the back plate, applying the charging device with a d.c. voltage of −5.5 KV, and keeping the grid voltage at −50 V. With these arrangements under these conditions, reproduction of a trichromatic images was conducted and, in both the first and second examples, distinct images exhibiting no shear in colors and of good color reproduction were obtained.

Although all the foregoing descriptions were made on the examples of color copying machines employing three color separation filter and three primary color toners, the present invention is not limited to the illustrated examples, but it is of course possible to freely select, according to the purpose, the number of kinds and colors of the separation filters and the combination thereof with the colors of the corresponding toners. For example, a process is practicable to provide a dichromatic reproduction. As one example of the same, there is a process to use, as the photosensitive member, the one with G filters distributed therein and, as the original, the one formed of two color portions of red and black, in which fundamentally similar steps to the foregoing are taken (but the whole surface exposures are made by G and R, or by G and B). The obtainable reproduction through the process is made up of a reproduced black portion, corresponding to the black portion in the original, formed of black toner and red toner being virtually in black color, and a reproduced red portion, corresponding to the red portion in the original, formed of red toner.

Therefore, the photosensitive member described so far to have a distribution layer of "plural kinds of filters" may be a photosensitive member having a single kind of color separation filter and a portion lacking the filter (may be made of transparent resin, or air, or the like), in which case the portion lacking the filter may be regarded as a transparent filter and counted in the plural kinds of filters.

And, the "charging" used in the above description should be understood to include the case where the surface potential on the photosensitive member becomes zero, or the charges on the surface are erased, by the charging.

And, although the spectral characteristics for the lights for the whole surface exposure in the foregoing description have been provided by the one using the green (G), blue (B), and red (R) filters, that obtainable by other method may also be used, and the spectral characteristics themselves are not limited to those for G, B, and R. It is acceptable if they are such spectral characteristics that will form a latent image, by a whole surface exposure by a specific color, on the photosensitive member only at the specific filter portion (not limited to one kind) corresponding to the specific color.

Incidentally, in the image forming method according to the first invention, it is also practicable not to provide the charging device 26 in FIG. 1 and FIG. 18 but to adapt such that, after the image exposure by the image exposure device 6 and the charging by the charging device 16 thereof have been finished, the photosensitive member 4 makes one rotation without being subjected to the latent image forming and developing treatments, and thereafter, receives a charging treatment for the second time by the charging device 16 of the image exposure device 6 (the image exposure is not made this time), and thereafter image forming process is advanced in the same manner as described before.

Although the above described examples are all for normal image forming, it is a matter of course that the present invention is applicable to the photosensitive members having color separation function as described in Japanese Patent Application Nos. 59-199547, 59-201084, 59-201085, and 59-187045, or to the reversed image forming method.

As described in the foregoing, the present invention uses a photosensitive member having a surface insulating layer and having color separation function in the surface and adapted such that the treatment to flatten the surface potential on the photosensitive member is practiced between the step of the image exposure and and that of the whole surface exposure by a specific color, and therefore, flattening of the surface potential left uncompleted is made complete by the succeeding surface potential flattening treatment and undesired developing (such as the toner being attached to the portion where it should not be attached to) is prevented from occurring, and thus, a high quality of image free from color turbidity can be formed.

Another embodiment of the invention will be described in the following.

In practicing the method of the present invention, preferred modes of execution are the following (1), (2) or (3).

(1) In the developing step, that the gap between the image retainer and the developer feeding member is held larger than the thickness of the developer layer formed on the developer feeding member.

(2) That a developing step is taken to develop the latent image by the use of one-component developer and in this developing step, the following equation is satisfied $$0.2 \leqq V_{AC}/(d \cdot f) \leqq 1.6$$

where $V_{AC}$ (v) represents amplitude of the a.c. component of the developing bias, f(Hz) represents the frequency, and d (mm) represents the gap between the image retainer and the developer feeding member for feeding the developer.

(3) That a developing step is taken to develop the latent image by the use of multicomponent developer, and in this developing step, the following equation is satisfied $$0.2 \leqq V_{AC}/(d \cdot f)\ \{(V_{AC}/d) - 1500\}/f \leqq 1.0.$$

As to the above (1), (2), and (3), description will be given later.

The embodiment in which the present invention is applied to a multicolor image forming photosensitive member (hereinafter to be simply called a photosensitive member) and the process for multicolor image formation will be described in detail in the following. Although, in the following description, only the full color reproducing photosensitive member employing red, green, and blue filters transmitting therethrough only red light, green light, and blue light, respectively, as a color separation filter (a filter transmitting therethrough light beams of specific regions of wavelengths) is described, the colors of the color separation filter and the colors of the toners to be combined therewith are not limited to those mentioned above.

The process of the multicolor image formation employing the above mentioned photosensitive member will be described below with reference to FIG. 21.

Figure 21:
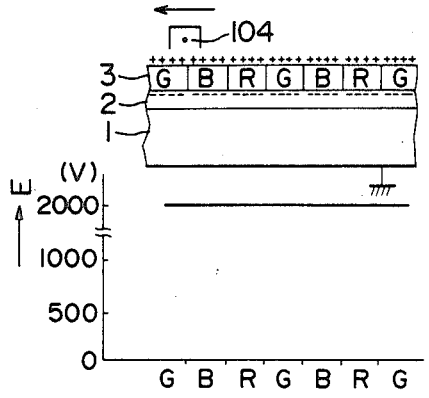
Figure 21:
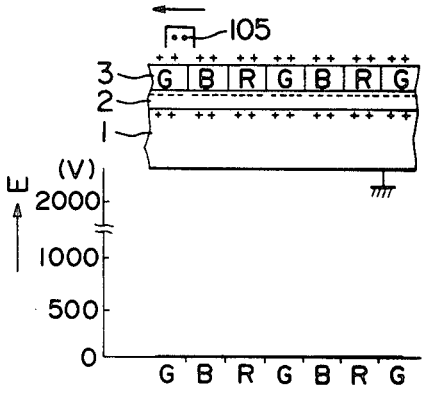
Figure 21:
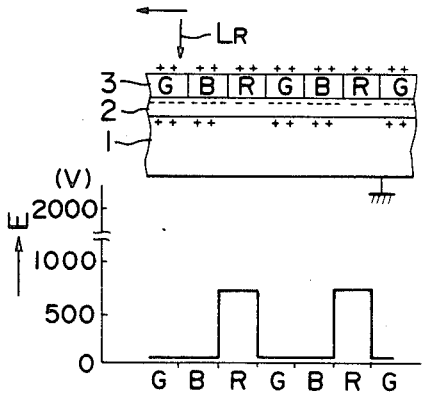
Figure 21:
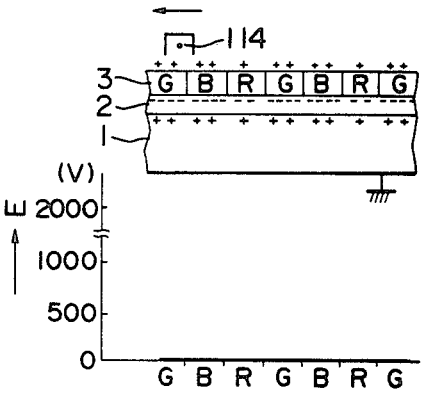
Figure 21:
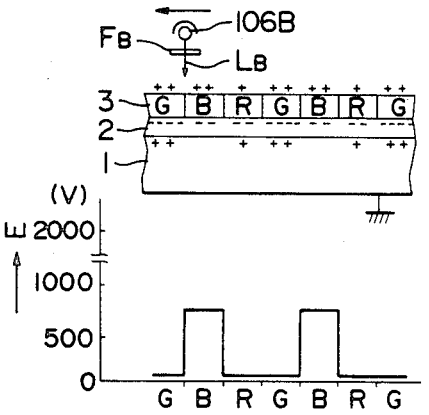
Figure 21:
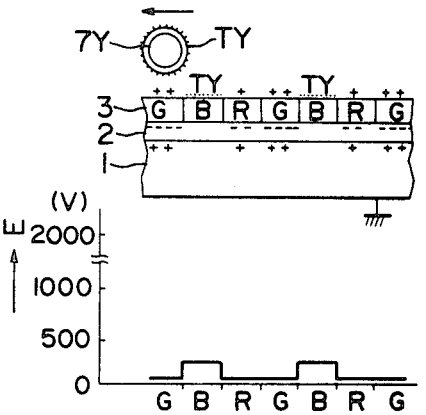
Figure 21G:
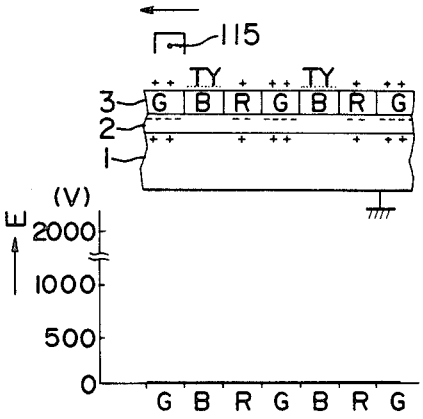
Figure 21H:
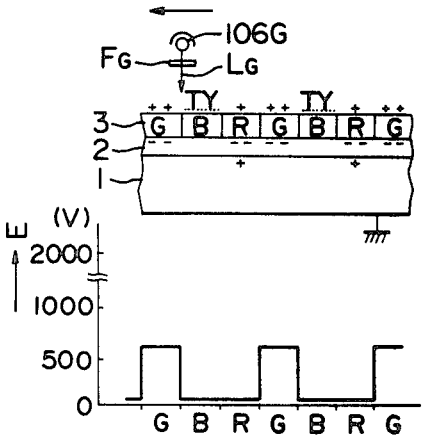
Figure 21I:
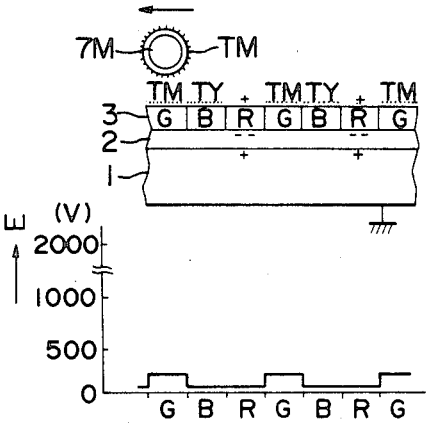
Figure 21J:
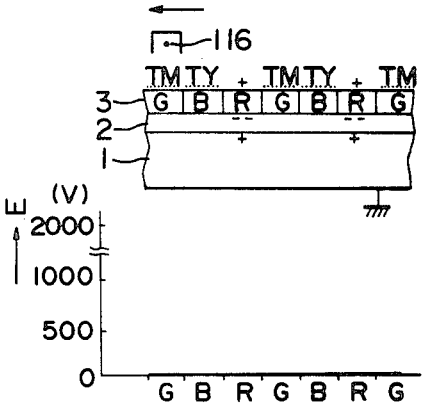

To begin with, if positive corona charging is applied to the whole surface by the primary charging device 104 as shown in FIG. 21(*a*), then positive charges are produced on the surface of the insulating layer 3 and, in response thereto, negative charges are induced on the boundary layer between the photoconductive layer 2 and the insulating layer 3.

Then, an a.c. or negative charge is applied by the secondary charging device 105 as shown in FIG. 21(*b*), whereby the charges on the surface of the insulating layer 3 are erased, and in succession thereto, an exposure of a color image, for example, a red color image exposure $L_R$ is applied as shown in FIG. 21(*c*).

Since the red light is transmitted through the red filter portion R of the insulating layer 3 and renders the photoconductive layer 2 at the portion thereunder conductive, the charges in the photoconductive layer 2 at that filter portion are erased. On the other hand, since the green filter portion G and blue filter portion B do not transmit the red light, the negative charges on the photoconductive layer 2 corresponding thereto remain intact. Then, the tertiary charging device 114 applies charging to smooth the potential. By the tertiary charging, the red filter portion R is not brought into an electrical equilibrium like other filter portions, but there is formed a potential pattern, if not strong, by irradiation of the light.

The steps up to the last mentioned stage corresponds to formation of a first latent image, and in this stage, the red filter portion R from where the charges are removed as well as G and B portions where the charges remain intact are all at equal potential level on the surface of the insulating layer, and there is present nothing that functions as an electrostatic image. In FIG. 21(*b*) and FIG. 21(*d*), the cases where the potential after the charging is brought to virtually zero are shown, but the charging may be given to make the potential negative.

In succession, a whole surface exposure is applied by the light of the same color as one of the colors included in the filters in the insulating layer 3, for example, by blue color $L_B$ obtained from the light source 106B and passed through the blue filter $F_B$, and then, the photoconductive layer 2 at the portion under the filter B allowing the blue light to pass therethrough is rendered conductive, and thereby, a portion of the negative charges on the photoconductive layer 2 at that portion and the charges on the conductive substrate 1 are neutralized, and as a result, there is produced a potential pattern only on the surface of the filter B. The portions corresponding to the filters G and R which do not allow the blue light to pass therethrough are not changed. When the image of the electric charges on the filter B is developed by the developer containing yellow toner TY negatively charged, the toner attaches only to the B portion on the insulating layer 3 held at a certain potential level and thus development is made (FIG. 21(*f*)).

If, after charging by the charging device 115 has been applied to erase the produced potential difference as shown in FIG. 21(*g*), a whole surface exposure by green light $L_G$ is made as shown in FIG. 21(*h*), a latent image is formed at the green filter G portion the same as in the case of the whole surface exposure by the blue light. By developing the same by magenta toner TM as shown in FIG. 21(*i*), the magenta toner attaches only to the filter G portion. In succession thereto, similar charging is made once again as shown in FIG. 21(*j*) and a whole surface exposure by red color is made. In this case, a weak potential pattern is formed at the red filter portion, but the cyan toner does not attach to the portion even if developing by cyan toner is conducted, That is, there is formed a potential pattern, may it be weak, but the developing bias is adjusted so that the toner will not attach thereto. This holds for the developing bias for other filter portions.

In the present invention, as described above, when the light of an image exposure passed through a specific filter is applied, it never occurs that the potential at the specific filter portion that is produced by the whole surface exposure of the specific color will be made virtually equal to the level of the background potential of such as the recharged potential, but there always is produced a fixed increase in the potential level. Therefore, it offers no problem even if a certain potential rise is caused at other filter portions by the dark decay in the photosensitive layer. At the time of developing in the past, under the condition that a specific filter portion at lower potential is developed, there was a problem that the toner attached also to other filter portions and thereby a color mixture was produced. And, if the developing bias was changed to provide the condition that would not cause the color mixture, there was produced another problem that nothing but a reproduction of poor gradation and full of highlights was obtained.

In the present invention, the potential at the filter portion produced by the whole surface exposure of a specific color is always held higher than other filter portions, even at the portions sufficiently irradiated by the light of the image exposure, and it is characteristic of the invention that the setting of the developing bias to around that potential will never produce the problem of the toner attaching to other filter portions causing the color mixture.

By transferring the toner image obtained as described above to a transfer material such as copying paper, and then fixing the same, a red image is reproduced on the transfer material blended of colors of the yellow toner and magenta toner.

Figure 22:
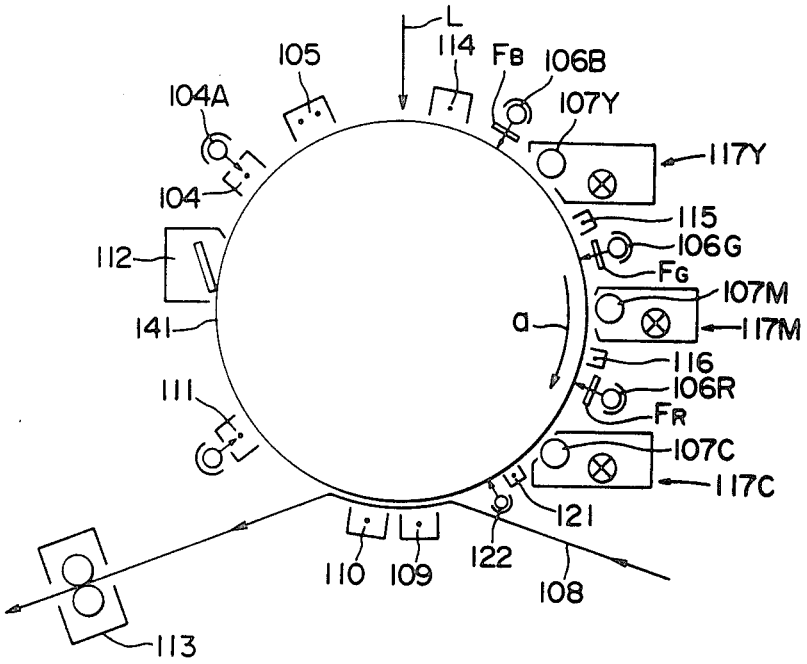

FIG. 22 is a schematic diagram of the image forming portion of a color copying machine suited for practicing the above described process of the present embodiment. Referring to the drawing, 141 denotes a photosensitive drum which is formed of the photosensitive member structured as indicated in FIG. 21 and rotates in the direction indicated by the arrow a during the copying operation. During its rotation, the photosensitive drum 141, according to the need, is given electric charges onto its whole surface by a charging electrode (primary charging device) 104 while being simultaneously irradiated by the light from a light source 104A (the irradiation of the light may be given immediately before the charging), receives a corona discharge of a.c. or opposite sign to the electrode 104 from an electrode (secondary charging device) 105, receives original image exposure L, and then receives from an electrode (tertiary charging device) 114 an a.c. or d.c. corona discharge for smoothing the potential and thereby the step of formation of the primary latent image is finished. Thereupon, a whole surface exposure is given by blue light obtained by the combination of a light source 106B and a blue filter $F_B$ for the light source and development by a developing sleeve 107Y of a developing device 117Y containing yellow toner is performed. Then, after recharging by a charging device 115, a whole surface exposure by green light from a light source 106G and a green light source filter $F_G$, development by a developing sleeve 107M of a developing device 117M containing magenta toner, and recharging by a charging device 116 are performed, and then, a whole surface exposure by red color from a light source 106R and a red light source filter $F_R$ and development by a developing sleeve 107C of a developing device 117C containing cyan toner are performed, and thereby, a multicolor image is formed on the photosensitive drum. The thus obtained toner image is transferred by a transfer electrode 109 onto copying paper 108 fed in by paper supply means not shown. Reference numeral 121 denotes a pre-transfer charging electrode and 122 denotes a pre-transfer exposure lamp. The copying paper 108 carrying the transferred multicolor image is separated from the photosensitive drum 141 by a separating electrode 110, fixed by a fixing device 113, and discharged as a completed polychromatic reproduction out of the machine. On the other hand, the photosensitive drum 141 after the transfer is subjected, to be deprived of its electricity, to a charge eliminating electrode 111 and, when necessary, simultaneous irradiation of a charge eliminating light and cleared of residual toner on its surface by a cleaning device 112 and thereby made ready for another use.

In the above described image forming process, the developer to be used may be either that using a non-magnetic toner or a magnetic toner, a so-called one-component developer, or that being a mixture of a toner and iron powder or the like, a so-called two-component developer. In developing, the method of direct sliding with a magnet brush may be used, but adoption of a non-contact developing method in which the developer layer on the developing sleeve does not slide on the surface of the photosensitive member becomes essential, at least for the development in the second time and thereafter, to avoid injury of a toner image which is formed already. This non-contact method, using a one-component or two-component developer having non-magnetic toner or magnetic toner of freely selectable color and forming an alternating field in the developing region, enables the development without putting the electrostatic image retainer (photosensitive member) in sliding contact with the developer layer. Detailed description thereof will be given in the following.

In such a method for repeated development employing an alternating electric field, while it is enabled to repeat development several times on a photosensitive member on which a toner image is already formed, such troubles are liable to occur if the developing conditions are not properly established that the toner image formed on a photosensitive member in the preceding stage is disturbed by development in the later stage, or that the toner already attached onto the photosensitive member is returned to the developing sleeve as the developer transferring member and the toner further enters the developing device in the later stage containing a developer of different color from that of the developer in the preceding stage, and thereby color mixing occurs. After investigations of these problems, it has been made clear that there are image forming conditions for each of the processes using one-component developer and using two-component developer that will enable recording of images with proper density and free from disturbance in the image and mixture of colors, when one-component developer or two-component developer is used. The developing condition in substance is to make the operation with the developer layer on the developing sleeve kept out of contact with the photosensitive member. To achieve this, the distance between the image retainer and the developing sleeve is held larger than the thickness of the developer layer on the developing sleeve (when there is no potential difference between both the members).

A more preferred condition is, in the process, succeeding to the step of forming a latent image on the image retainer, to take the developing step for developing the latent image with one-component developer whereby a plurality of toner images are formed on the image retainer, to satisfy the following equation in the developing stage.

$$0.2 \leqq V_{AC}/(d \cdot f) \leqq 1.6$$

where $V_{AC}$(v) represents the amplitude of the a.c. component of the developing bias, f (Hz) represents the frequency, and d (mm) represents the distance between the image retainer and the developer feeding member for transferring the developer.

And it is preferred, in the process, succeeding to the step of forming a latent image on the image retainer, to take the developing step for developing the latent image with multicomponent developer, whereby a plurality of toner images are formed on the image retainer, that the following equation is satisfied in the developing stage $$0.2 \leqq V_{AC}/(d \cdot f)\{(V_{AC}/d) - 1500\}/f \leqq 1.0$$

where $V_{AC}$(v) represents the amplitude of the a.c. component of the developing bias, f (Hz) represents the frequency, and d (mm) represents the distance between the image retainer and the developer feeding member for transferring the developer.

The present inventor discovered through studies on the above described method, forming an image by repeated formation of the latent image and development of the image, that there is a range for selection of proper developing conditions as to a.c. bias voltage, frequency, and so on, and under these conditions, an image of high quality, free from disturbance in the image and mixture of colors can be obtained.

Figure 24:
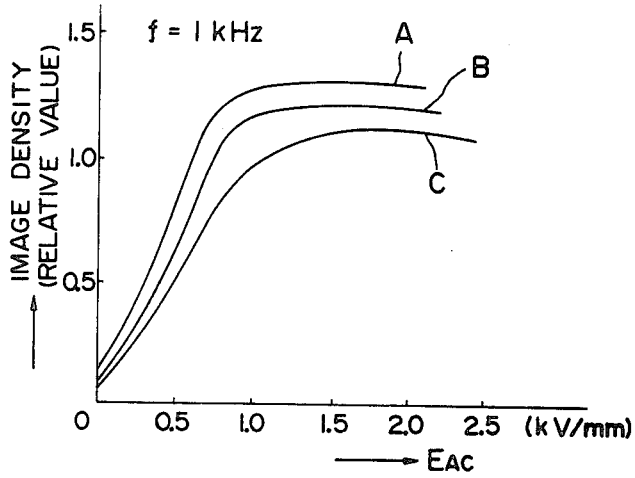
Figure 25:
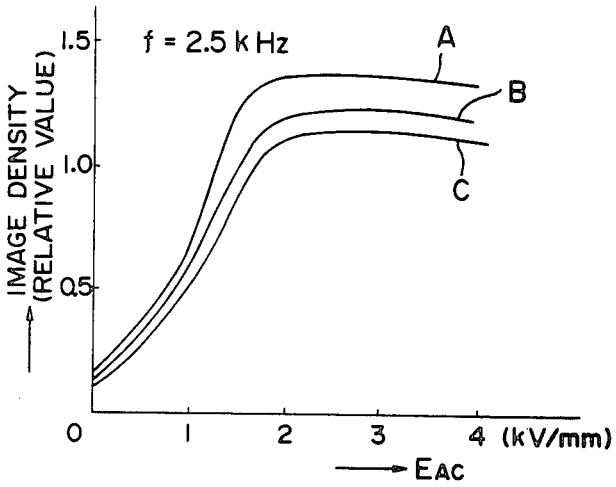

In the method superimposing toner images in succession on an image retainer (for example, a photosensitive drum), it is required in the developing step that the toner image formed on the image retainer in the preceding stage is not disturbed and the development produces proper density. Here, the superimposing means that there is previously formed an toner image on the image retainer, then an electrostatic latent image is formed on the image retainer by recharging and uniform exposure with specific light, a toner or toners from one or a plurality of developing devices are attached onto the electrostatic latent image, and thereby, a toner image is formed. After investigations, it was made clear that an excellent image is difficult to obtain by only individually determining values of the distance d (mm) between the image retainer and the developer feeding member in the developing region (sometimes, hereinafter to be simply referred to as a gap d), the amplitude $V_{AC}$(v) of the a.c. component of the developing bias, and the frequency f (Hz), but these parameters, to satisfy the above mentioned conditions, are closely interrelated with each other. And so, experiments were conducted by the use of the color copying machine of FIG. 22, including the developing devices of the type of the developing device 117 of FIG. 23 using a one-component magnetic toner, under conditions of varied parameters such as voltage and frequency of the a.c. component of the developing bias, and results as shown in FIGS. 24 and 25 were obtained. And, there was previously formed a toner image on the photosensitive drum 141. The above mentioned developing devices correspond to the developing devices 117Y, 117 M, and 117C as shown in FIG. 22, wherein it is adapted such that a sleeve 107 and/or a magnet roll 143 is rotated and a developer D is thereby transferred on the peripheral surface of the sleeve 107 in the direction indicated by the arrow B and the developer D is supplied to the developing region E. By the way, the developer D is a one-component magnetic developer made up of 70 w% of thermoplastic resin, 10 w% of pigment (carbon black), 20 w% of magnetic material, and charge controlling agent, which are kneaded and crushed into 15 μm of average particle size, and then added with fluidizing agent such as silica. The quantity of charges is controlled by the charge controlling agent. As the magnet roll 143 is rotated in the direction indicated by the arrow A and the sleeve 107 is rotated in the direction indicated by the arrow B, the developer D is transferred in the direction indicated by the arrow B. The developer D while being transferred is controlled in thickness by an ear controlling blade 140 made of a magnetic material. There is provided a stirring screw 142 in a developer-reservoir 147 to stir the developer D sufficiently, and when the toner within the developer reservoir 147 is consumed, a toner supply roller 139 is rotated to supply toner T from a toner hopper 138.

A d.c. power source 145 is provided between the sleeve 107 and the photosensitive drum 141 for supplying the developing bias, and in series therewith, an a.c. power source is connected for vibrating the developer D within the developing region E so that the developer D may be sufficiently supplied to the photosensitive drum 141. R denotes a protective resistor.

FIG. 24 shows the relation between the amplitude of the a.c. component and the image density of the black toner image formed on the photosensitive drum 141 at the unexposed portion (the potential at the exposed portion was 0 V) under the setting of the distance d between the photosensitive drum 141 and the sleeve 107 at 0.7 mm, the thickness of the developer layer at 0.3 mm, the d.c. component of the developing bias applied to the sleeve 107 at 50 V, the frequency of the a.c. component of the developing bias at 1 kHz, and the maximum potential on the photosensitive member produced by the whole surface exposure, performed in succession to the charging, at 500 V. The amplitude $E_{AC}$ of the a.c. electric field strength is the value of the amplitude $V_{AC}$ of the a.c. voltage of the developing bias divided by the distance d. The curves A, B, and C shown in FIG. 24 represent results obtained in the cases where the magnetic toners whose average charge amounts were −5 μc/g, −3 μc/g, and −2 μc/g, respectively, were used. From all the three curves A, B, and C, it was observed that the image density was high in the range of the amplitudes of the a.c. component of the electric field between 200 V/mm and 1.5 kV/mm, and when the amplitude was made higher than 1.6 kV/mm, the toner image previously formed on the photosensitive drum 141 was partially destroyed.

FIG. 25 shows the changes in the image density with changes of the magnitudes of the a.c. electric field strength, etc. when the frequency of the a.c. component of the developing bias was set at 2.5 kHz and otherwise under the same conditions as in the experiments of FIG. 24.

According to these experiments, the image density was high within the range of the above mentioned amplitudes $E_{AC}$ between 500 V/mm and 3.8 kV/mm, and when the amplitude exceeded 3.2 kV/mm, the toner image previously formed on the photosensitive drum 141 was partially destroyed (not shown in FIG. 25).

As seen from the results of FIGS. 24 and 25, the image density tends to saturate or slightly fall after the amplitude has exceeded a certain value, but the value of the amplitude showing that tendency is not so much dependent on the average charge amount of the toner as seen from these curves A, B, and C. The reason for that is considered to be like this. Namely, in the one-component developer, it is presumed that the charge amounts are widely distributed in both positive and negative directions due to friction between the toner particles. And so, although the average charge amount is of low value, there are considered to be included such toner particles having larger charge amounts, for example, those having 20 $\mu c/g$ or above, amounting to a certain fixed portion of the developer, and it is considered that these toner particles are mainly used for the developing. Even if the average charge amount is controlled by the charge controlling agent, it is considered that the percentage formed by the toner particles having such larger charge amounts does not change so much, and thus, the change in the developing characteristic becomes unobservable.

Figure 26:
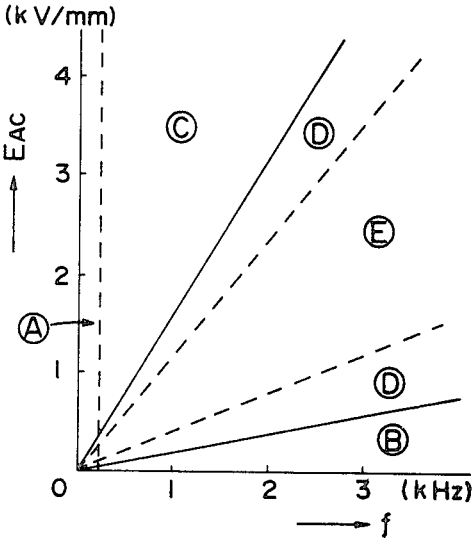

By continuing experiments similar to those of FIGS. 24 and 25 under changed conditions, the relations between the amplitude $E_{AC}$ and the frequency f could be put in order and a result as shown in FIG. 26 was obtained.

In FIG. 26, the domain denoted by (A) represents the region where uneven development is liable to be produced because of low-frequency developing bias, the domain denoted by (B) represents the region where the effect of the a.c. component is not observable, the domain denoted by (C) represents the region where the toner image previously formed is liable to be destroyed, and the domains denoted by (D) and (E) are the regions where the effect of the a.c. component is achieved, sufficient developing density is obtained, and the toner image previously formed is not destroyed, and the domain (E) represents the region which is especially preferable.

These results indicate that in order to develop a toner image (of a later stage) in proper density on the photosensitive drum 141 without destroying a previously formed image (in the preceding stage), there is a proper region for selecting the amplitude of the a.c. electric field strength and the frequency from within thereof. The reason for the above can be considered like this.

In the region where the image density tends to increase with increase of the amplitude $E_{AC}$ of the a.c. electric field strength, for example, within the range of the amplitude $E_{AC}$ between 0.2 and 1 kV/mm of the density curve A in FIG. 4, the a.c. component of the developing bias acts so that the toner from the sleeve may easily exceed the threshold value for flying, whereby even the toner particles of smaller charge amounts can be attached to the photosensitive drum 141 and thereby used for development. Therefore, the image density becomes the higher as the amplitude $E_{AC}$ becomes larger.

On the other hand, the reasons for the picture image density to saturate or slightly fall with the increase of the amplitude of the a.c. field (for example, with the density curve A in FIG. 24, in the region of the amplitude $E_{AC}$ of the a.c. electric field strength exceeding 1 kV) can be considered in several ways. As the amplitude $E_{AC}$ of the a.c. electric field strength becomes larger, the toner is vibrated stronger and clusters formed by the toner particles put together become to be easily crushed and the toner particles having large charges are selectively attached to the photosensitive drum 141, while the toner particles having smaller charges become difficult to be used for development. Or, even if these toner particles with smaller charges are once attached to the photosensitive drum 141, they are liable to be returned to the sleeve 107 by the a.c. bias because of their weak image-force. Further, if the amplitude of the a.c. electric field strength of the a.c. component is too large, such a phenomenon becomes liable to occur that the charges on the surface of the photosensitive drum 141 leak, and thereby, the toner becomes difficult to be used for development. These factors are considered, in reality, to be combined to cause the saturation or fall of the image density.

On the other hand, the toner image previously formed on the photosensitive drum 141 became to be destroyed as the amplitude $E_{AC}$ of the a.c. electric field strength was made larger as described in the foregoing, and the degree of the destruction was the larger as that the a.c. component was made larger. The reason for this is considered to be a build-up of force to return the toner to the sleeve 107 caused by the a.c. component acting on the toner attached onto the photosensitive drum 141. In superimposing toner images in succession on the photosensitive drum 141, it is in fact a serious problem that the toner image already formed is destroyed at the time of development in the later stage.

It was found through experiments with varied frequencies of the a.c. component, as also seen from comparison of FIG. 24 with FIG. 25, there was a tendency that the higher the frequency was, the lower the image density became. The reason for this is that the toner particles become unable to follow the changes of the electric field and the range of the vibration is narrowed down, and thereby, it is made difficult for the toner to be attracted and attached to the photosensitive drum 141.

Based upon these test results, the present inventor has reached a conclusion that later development can be performed to provide proper density without disturbing a toner image already formed on the photosensitive drum 141 if the development is conducted under the conditions to satisfy the following equation in each developing stage $$0.2 \leqq V_{AC}/(d \cdot f) \leqq 1.6$$

where $V_{AC}$ (v) represents the amplitude of the a.c. component of the developing bias, f (Hz) represents the frequency, and d (mm) represents the distance between the photosensitive drum 141 and the sleeve 107. In order that the later development is performed to provide sufficient density and without disturbing the toner image already formed on the photosensitive drum 141, it is more preferable that the conditions are in the region where the image density increases with increase in the a.c. electric field in FIGS. 24 and 25, namely, that the conditions satisfy $$0.4 \leqq V_{AC}/(d \cdot f) \leqq 1.2$$

And, it is most preferable that the conditions are in the region where the field is lower than the saturation of the image density, namely, that the conditions satisfy $$0.6 \leqq V_{AC}/(d \cdot f) \leqq 1.0.$$

And, in order to prevent uneven development, it is further desired that the frequency f is made higher than 200 Hz, and if a rotating magnet roll is employed as the means for supplying the developer to the photosensitive drum 141, the frequency of the a.c. component is made higher than 500 Hz so as to eliminate the effect of beats which will be produced by the a.c. component and the rotation of the magnet roll.

Figure 23:
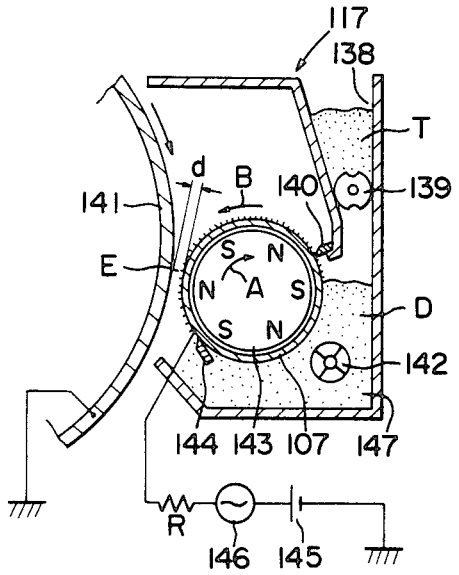
Figure 27:
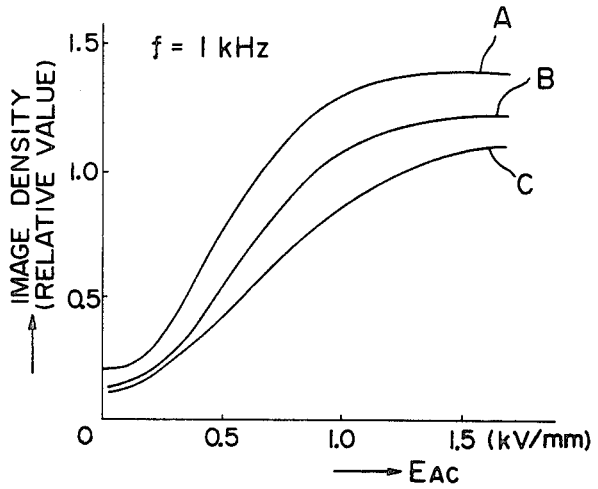
Figure 28:
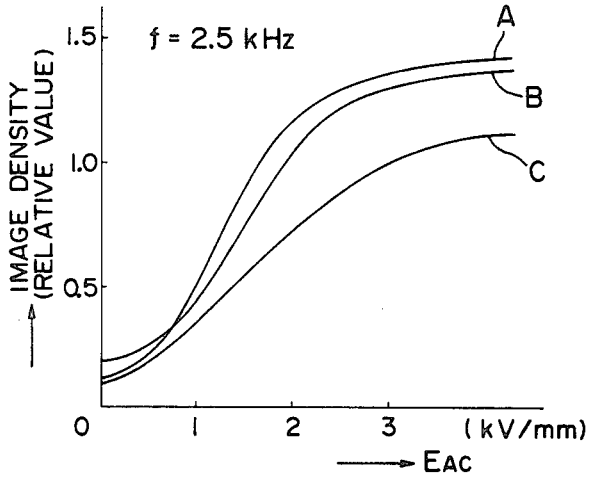

Then, experiments were conducted similarly to the above described experiments with a two-component developer put in the developing device 111 of FIG. 23, and results as shown in FIGS. 27 and 28 were obtained. The developer D was two-component developer constituted of magnetic carrier and non-magnetic toner. The carrier was such that was produced by dispersing fine particles of iron oxide in a resin exhibiting physical characteristics of 20 μm of average particle size, 30 emu/g of magnetization, and $10^{14}$ Ω.cm of resistivity. Incidentally, the resistivity is such a value that was obtained from the reading of the current flowing through the particles which were put in a container of 0.50 $cm^2$ in cross-section tapped thereinto, and put under a load of 1 $kg/cm^2$, and applied with such a voltage that would produce 1000 V/cm of electric field between the load and the bottom electrode. The toner was such that was produced by kneading a mixture of 90 wt% of a thermoplastic resin and 10 wt% of pigment (carbon black) with a small amount of charge controlling agent added thereto and then crushing the same into particles of 10 μm in average particle size. The toner was mixed with the carrier in the ratio of 20% to 80% to provide the developer D. By the way, the toner is negatively charged by friction with the carrier.

FIG. 27 shows the relation between the amplitude of the a.c. component and the image density of the black toner image formed on the photosensitive drum 141 at the unexposed portion (the potential at the exposed portion was 0 V) under the setting of the distance d between the photosensitive drum 141 and the sleeve 107 at 1.0 mm, the thickness of the developer layer at 0.7 mm, the maximum potential value of the photosensitive member at 500 V, the d.c. component of the developing bias at 50 V, and the frequency of the a.c. component of the developing bias at 1 kHz. The amplitude $E_{AC}$ of the a.c. electric field strength is the value of the amplitude $V_{AC}$ of the a.c. voltage of the developing bias divided by the distance d. The curves A, B, and C shown in FIG. 27 represent results obtained in the cases where the magnetic toners whose average charge amounts were −30 μc/g, −20 μc/g, and −15 μc/g, respectively, were used. In all the three curves A, B, and C, effects of the a.c. component were observed where the amplitudes of the a.c. component of the electric field was higher than 200 V/mm, and when the amplitude was made higher than 2500 kV/mm, it was observed that the toner image previously formed on the photosensitive drum was partially destroyed.

FIG. 28 shows the changes in the image density with changes of the amplitude of the a.c. electric field strength $E_{AC}$, when the frequency of the a.c. component of the developing bias was set at 2.5 kHz and otherwise under the same conditions as in the experiments of FIG. 27.

According to these experiments, the image density was high where the above mentioned amplitudes $E_{AC}$ of the a.c. electric field strength was higher than 500 V/mm, and when the amplitude exceeded 4 kV/mm although not shown, the toner image previously formed on the photosensitive drum 141 was partially destroyed, although it is not shown in the graph.

As seen from the results of FIGS. 27 and 28, the image density tends to saturate or slightly fall after the amplitude has exceeded a certain value, but the value of the amplitude showing that tendency is not so much dependent on the average charge amount of the toner as seen from these curves A, B, and C. The reason for that is considered to be like this. Namely, it is presumed that the toner particles are charged by friction with the carrier as well as with other toner particles and the charge amounts on the toner particles are widely distributed, although, in this case of two-component developer, it may not so much as in the case of one-component developer, and it is considered that the toner particles having larger charge amounts are used for development preferentially. Even if the average charge amount is controlled by the charge controlling agent, it is considered that the percentage formed by the toner particles having such larger charge amounts does not change so much, and so, the change in the developing characteristic becomes inconspicuous, if observable to a certain degree.

Figure 29:
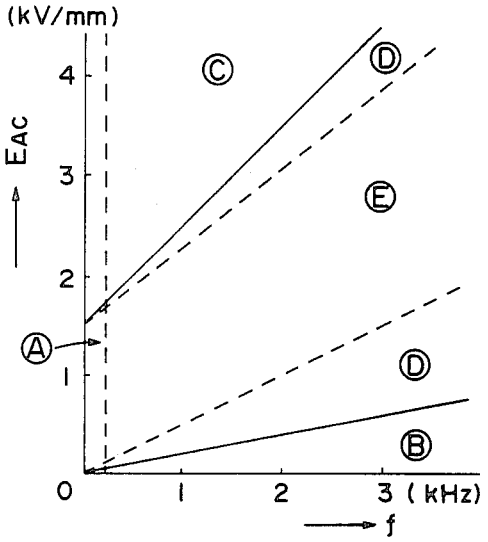

By continuing similar experiments to those of FIGS. 27 and 28 under changed conditions, the relations between the amplitude $E_{AC}$ and the frequency f could be put in order and a result as shown in FIG. 29 was obtained.

In FIG. 29, the domain denoted by (A) represents the region where uneven development is liable to occur because of low-frequency developing bias, the domain denoted by (B) represents the region where the effect of the a.c. component is not observable, the domain denoted by (C) represents the region where the toner image previously formed is liable to be destroyed, and the domains denoted by (D) and (E) are the regions where the effect of the a.c. component is achieved, sufficient developing density is obtained, and the toner image previously formed is not destroyed, and the domain E represents the region which is especially preferable.

These results indicate that in order to develop a toner image (in a later stage) in proper density on the photosensitive drum 141 without destroying the image formed in the preceding stage, there is a proper region for selecting the amplitude of the a.c. electric field strength and the frequency from within thereof. The reason for the above is the same as described previously with the one-component developer.

That is, in the region where the picture image density tends to increase with increase of the amplitude $E_{AC}$ of the a.c. electric field strength, for example, within the range of the amplitude $E_{AC}$ between 0.2 and 1.2 kV/mm of the density curve A in FIG. 27, the a.c. component of the developing bias acts so that the toner from the sleeve may easily exceed the threshold value for flying, whereby even the toner particles of smaller charge amounts can be attached to the photosensitive drum 141 and thereby used for development. Therefore, the image density becomes the higher as the amplitude $E_{AC}$ becomes larger.

On the other hand, the phenomenon for the image density to saturate with the increase of the amplitude $A_{AC}$ of the a.c. field strength in the region, for example, of the amplitude $E_{AC}$ of the a.c. electric field strength exceeding 1.2 kV/mm with the curve A in FIG. 27, can be explained in the following manner. That is, in the above mentioned region, as the amplitude $E_{AC}$ of the a.c. electric field strength becomes larger, the toner is vibrated the stronger and clusters formed by the toner particles put together become to be easily crushed and the toner particles having large charges are selectively attached to the photosensitive drum 141, while the toner particles having smaller charges become difficult to be used for development. Or, even if these toner particles with smaller charges are once attached to the photosensitive drum 141, they are liable to be returned to the sleeve 107 by the a.c. bias because of their weak image-force. Further, if the amplitude of the a.c. electric field strength of the a.c. component is too large, such a phenomenon becomes liable to occur that the charges on the surface of the photosensitive drum 141 leak, and thereby, the toner becomes difficult to be used for development. These factors are considered to be combined to hold the image density constant against the increase of the a.c. component in reality.

When the a.c. field strength was made still higher, for example, the amplitude, under the conditions in which the curve A of FIG. 27 was obtained, was made larger than 2.5 kV/mm, it was observed, as previously described, that the toner image previously formed on the photosensitive drum 141 became to be destroyed and the degree of the destruction was the larger as the a.c. component became larger. The reason for this is considered to be a build-up of force caused by the a.c. component acting on the toner attached onto the photosensitive drum 141 to return the toner to the sleeve 107.

In developing by superimposing toner images in succession on the photosensitive drum 141, it is really a serious problem that the toner image already formed is destroyed at the time of development in the later stage.

Through experiments with varied frequencies of the a.c. component, it was found, as also seen from comparison of FIG. 27 with FIG. 28, that the higher the frequency was, the lower the image density became. The reason for this is that the toner particles become unable to follow the changes of the electric field and the range of the vibration is narrowed down, and it is thereby made difficult for the toner to be attracted and attached to the photosensitive drum 141.

Based upon these test results, the present inventor has reached a conclusion that later development can be performed to provide proper density without disturbing a toner image already formed on the photosensitive drum 141 if the development is conducted under the conditions to satisfy the following equation in each developing stage $$0.2 \leqq V_{AC}/(d \cdot f)\{(V_{AC}/d) - 1500\}/f \leqq 1.0$$

where $V_{AC}$(v) represents the amplitude of the a.c. component of the developing bias, f (Hz) represents the frequency, and d (mm) represents the distance between the photosensitive drum 141 and the sleeve 107. In order that the later development is performed to provide sufficient density and without disturbing the toner image already formed on the photosensitive drum 141, it is more preferable that the conditions particularly satisfy $$0.5 \leqq V_{AC}/(d \cdot f)\{(V_{AC}/d) - 1500\}/f \leqq 1.0.$$

And, if, in particular, $$0.5 \leqq V_{AC}/(d \cdot f)\{(V_{AC}/d) - 1500\}f \leqq 0.8$$

is satisfied, a multicolor image being more distinct and free from color turbidity can be obtained and different color of toner is prevented from mixing in a developing device even if operations are repeated many times.

And, in order to prevent uneven development due to the a.c. component, the same as in the case where the one-component developer was used, it is further desired that the frequency is made higher than 200 Hz, and if a rotating magnet roll is employed as the means for supplying the developer to the photosensitive drum 141, the frequency of the a.c. component is made higher than 500 Hz so as to eliminate the effect of beats which will be produced by the a.c. component and the rotation of the magnet roll.

The image forming process according to the present invention is as exemplified in the foregoing. In order to develop succeeding toner images so as to provided constant density on the photosensitive drum 141 without destroying previously formed toner image on the photosensitive drum 141, it is further preferable that the following methods are employed independently or in some combination through the course of repeated developing operations (1) To use toner with increased charge amounts by degrees.

(2) To decrease by degrees the amplitude of the electric field strength of the a.c. component of the developing bias.

(3) To increase by degrees the frequency of the a.c. component of the developing bias.

Since the larger the charge amount of a toner particle is, the larger it receives the effect of the electric field, if toner particles with large charge amounts are attached to the photosensitive drum 141 in development in the earlier stage, it may occur that these toner particles are returned to the sleeve in development in the later stage. Therefore, the method (1) above is to prevent the previously used toner particles in development from returning to the sleeve in development in the later stage by using toner particles with smaller charge amounts in development in the earlier stage. The method (2) above is to prevent return of the toner particles that are already attached to the photosensitive drum 141 by decreasing the electric field strength by degrees as the developing operations are repeated (namely, as the developing operation becomes that of the more and more rearward stage). As concrete methods for decreasing the electric field strength, there are one to lower by degrees the voltage of the a.c. component and the other to gradually widen the gap d between the photosensitive drum 141 and the sleeve 107 as the developing becomes that of more and more rearward stage. And the method (3) above is to prevent the return of toner particles already attached to the photosensitive drum 141 by increasing the frequency of the a.c. component as the developing operations are repeated. Effect is obtained by employing any of the methods (1), (2) and (3) independently, but more effect is obtained if they are employed in combination, for example, if, as the developing operations are repeated, the toner charge amount is gradually increased and, at the same time, the a.c. bias is gradually decreased. Further, when employing some of these three methods, proper image density or color balance is provided by adjusting the d.c. bias case by case.

Figure 30:
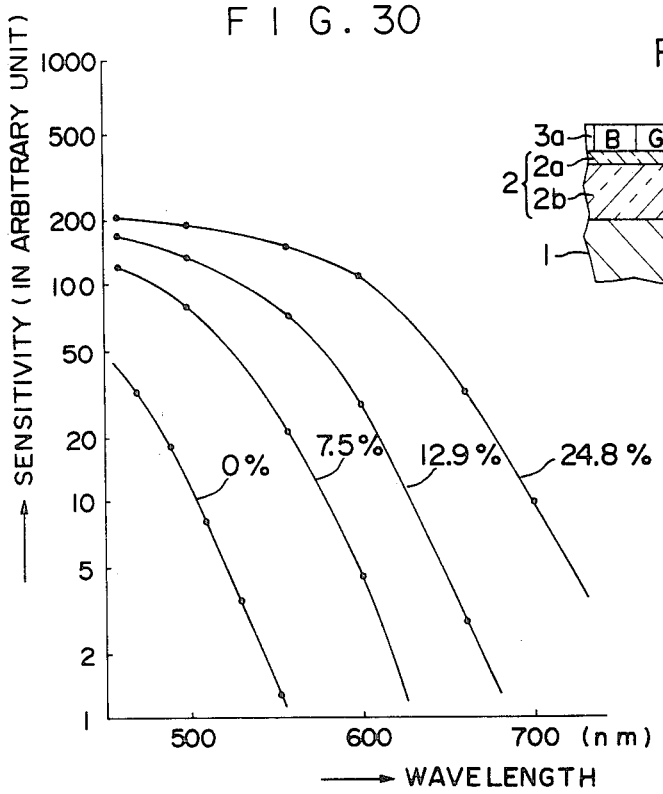

FIG. 30 shows spectral sensitivity of Se-Te group photoconductive layer, in which the wavelength region varies with Te content. It is known from the graph that the Se-Te group photoconductive layer containing approximately 20% of Te is preferably used. In the graph, the percentage indicates the Te content (percent by weight).

Some of organic photoconductive materials (OPC) do not have spectral sensitivity to infrared radiation. Their spectral sensitivity characteristics are exemplified in FIG. 31. While two-layer structure as shown in FIG.

Figure 31:
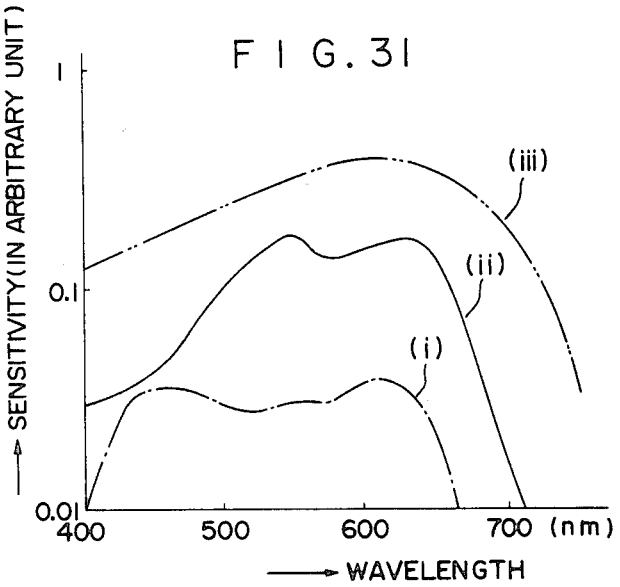

32 made up of a charge generating layer (CGL) 2*a* and a charge transfer layer (CTL) 2*b* is suited as the photo-used. The substances constituting the photoconductive layers in FIG. 31 are shown in Table 2.

TABLE 2

CGL (i)

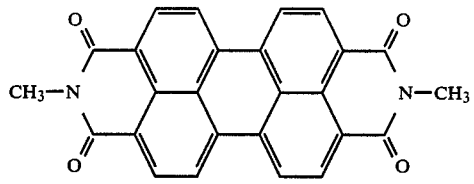

(ii)

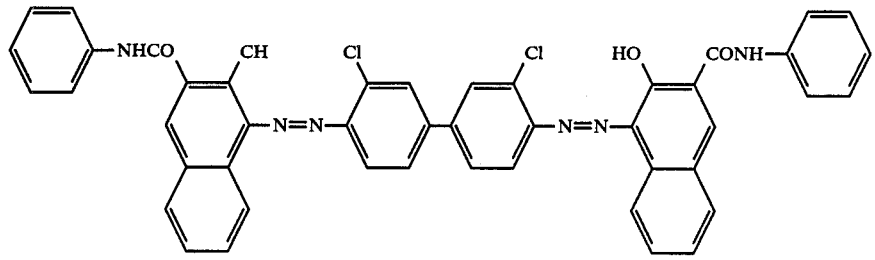

(iii)

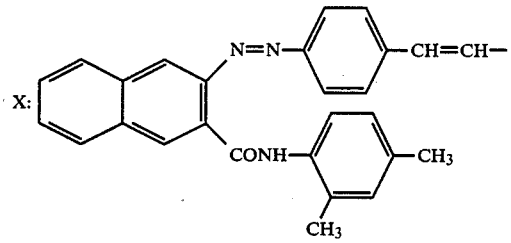

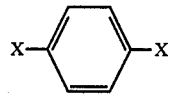

CTL (i)

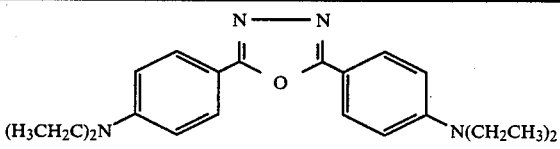

(ii)

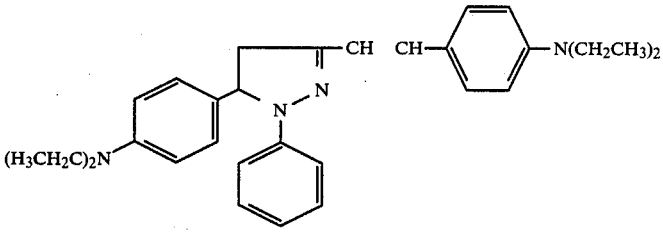

(iii)

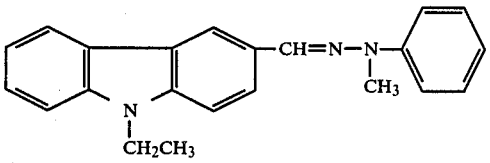

sensitive member having a photoconductive layer of such OPC, that of a single layer of a mixture of these is also usable. In the two-layer structure, such a one of which the CGL is formed of a charge generating material and a material of the CTL as a binder is preferably Their spectral sensitivity to infrared radiation is substantially nil or low, if any. To ultraviolet radiation, (i) is substantially not sensitive. When a photoconductive layer having spectral sensitivity to infrared or ultraviolet radiation, in substance, is used as a photoconductive layer, the design is made so that any of the color separation filters B, G, and R does not have spectral transmittance in the regions less than 400 nm (ultraviolet component) and larger than 700 nm (infrared component), or the image exposure does not include ultraviolet component and infrared component.

Figure 33:
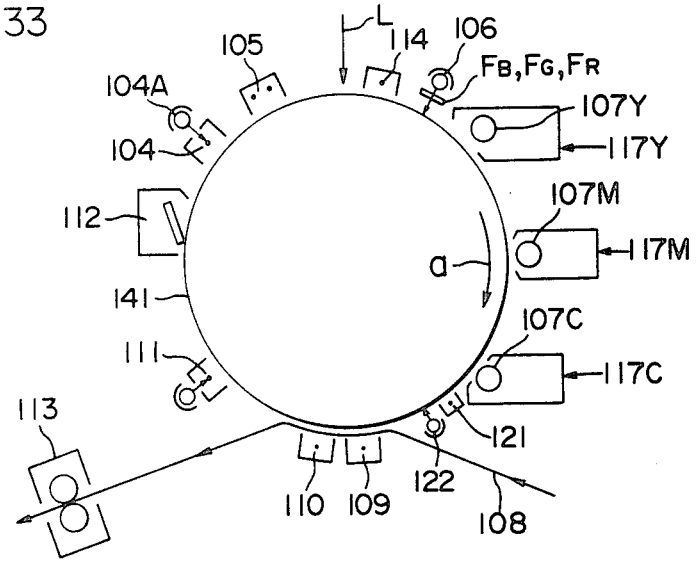

The multicolor image forming apparatus shown in FIG. 33 is such that forms a single color toner image for one rotation of the photosensitive member 141 and the same is differs from the image forming apparatus of FIG. 22 in that the whole surface exposure is made by the use of a lamp 106 having filters $F_B$, $F_G$, and $F_R$ which can be selectively used by switching and the flattening of the surface potential of the photosensitive member 141 after the development is made by utilizing charging device 105 or 114. In the present multicolor image forming apparatus, like the multicolor image forming apparatus of FIG. 22, the image forming operations as described with reference to FIG. 21 are performed, and thereby multicolor images free from shear in the colors and monochromatic images excellent in image density and resolution can be formed. That is, when a three-color image is to be formed, for example, the photosensitive member 141 is charged by a primary charging device 104 and the surface potential thereon is made even by the secondary charging device 105 and then an image exposure L is applied. After discharging by the tertiary charging device 114, a whole surface exposure by the light from the lamp 106 passed through the blue filter $F_B$ is applied onto the surface of the photosensitive member 141, and a potential pattern thereby formed is developed by a developing device 108Y into a yellow toner image. This toner image passes by developing devices 108M and 108C, a pre-transfer discharging device 121, transfer device 109, separating device 110, cleaning device 116, and the primary charging device 104 without being affected thereby. The photosensitive drum 141 with the toner image formed thereon when reached the position of the tertiary charging device 114, for example, receives a corona discharge therefrom so that its surface potential is made even, and then receives a whole surface exposure by the light provided by means of the lamp 106 and the red filter $F_R$ and a potential pattern is thereby formed thereon. In succession, the pattern is developed by the developing device 108C and a cyan toner image is thereby formed. In like manner, formation of a potential pattern by the lamp 107 and the green filter $F_G$ and development by the developing device 108M are performed and thus a three-color toner image is provided. The order of the whole surface exposures and the use of the developing devices is not limited to that which was described above. The present multicolor image forming apparatus is structured virtually as simply as a monochromatic copying machine and therefore has features to be produced in smaller size and at lower cost. Identical reference characters in FIG. 33 to those in FIG. 22 denote members performing identical functions.

Concrete examples of experiments conducted according to the above described arrangements by the use of the apparatus of FIG. 22 and FIG. 23 will be described in the following.

EXPERIMENT 1

The recording apparatus of FIG. 22 was used. But, the photosensitive member 141 was such that was fabricated by disposing an Se-Te photosensitive layer of a thickness of 40 μm intensified for long wavelength on a nickel substrate and by applying onto the same an insulating layer of a thickness of 20 μm of the structure as shown in FIG. 3 and in FIGS. 9 to 11, the filter size l thereof being 300 μm×300 μm, and the peripheral speed of the photosensitive member was set at 100 mm/sec. The photosensitive member 141 was charged by a corotron corona discharging device (primary charging device) 104 so that the surface potential on the photosensitive member 141 would become −2000 V. Then charging was made by a secondary charging device 105 constituted of a scorotron charging device having the a.c. component so that the surface potential on the photosensitive member 141 would become +100 V. Then an image exposure was made. At the image exposure, a halogen lamp was used and the infrared radiation and ultraviolet radiation were previously cut off by filters. Then charging was performed by a scorotron charging device (tertiary charging device) 114 so that the surface potential would become approximately +100 V.

Thereafter, by applying a uniform exposure through a blue filter, an electrostatic image was formed which had −300 V against 0 V at the background portion. The potential contrast then produced was approximately $\frac{1}{3}$ of that produced at the time a transparent insulating layer was used because the potential contrast had been divided into three by the filters. The electrostatic image was developed by the developing device 117Y as shown in FIG. 23.

In the developing device 117Y, a developer made up of such a carrier that is formed of a resin containing 50% by weight of magnetite dispersed therein, 30 μm in average particle size, 30 emu/g in magnetization, and $10^{14}$ Ω cm or higher in resistivity and such a positively charged non-magnetic toner that is formed of styrene-acrylic resin added with benzidine derivative as yellow pigment of a percentage of 10 by weight and, further, with a charge controlling agent, and 10 μm in average particle size, the toner being contained in the rate of 20% by weight in the developer. It was also arranged such that the outer diameter of the developing sleeve 107 was 30 mm, its number of revolutions was 100 rpm, the magnetic flux density of the poles N and S of the magnet member 143 was 900 gauss, its number of revolutions was 1000 rpm, the thickness of the developer layer in the developing region was 0.7 mm, and the gap between the developing sleeve 107 and photosensitive member 141 was 1.0 mm, and a non-contact developing system was employed with the developing sleeve 107 applied with a superimposed voltage of −50 V of d.c. voltage and 2.5 kHz, 2000 V of a.c. voltage (the amplitude of the sine wave was $\sqrt{2}\times 2000$ V).

Further, while the developing device 117Y was developing an electrostatic image, other developing devices 117M and 117C likewise shown in FIG. 22 were disabled to develop. This was achieved by cutting off the developing sleeves from the power sources 145 and 146 to put them in a floating state, grounding them, or, positively, by applying the developing sleeves with a d.c. bias voltage of the same polarity as the electrostatic image (i.e., opposite polarity to the charges on the toner), out of which the application of the d.c. voltage is preferable. And, at the time the developing devices were not developing, the drive of them was stopped. Since the developing devices 117M and 117C were made to make development on the non-contact developing system similarly to the developing device 117Y, it was not necessary to remove the developer layer on the developing sleeves. In the developing device 117M, such a developer was used which was of the same constitution as the developer used in the developing device 117Y except that its yellow pigment in the toner was replaced with polytungstophosphoric acid as magenta pigment, and in the developing device 117C, a developer of the same constitution except that its toner included copper phthalocyanine derivative as cyan pigment was used. AS color toners, those containing other pigment or dyestuff can of course be used, and the order of development can properly decided so that a distinct color image may be obtained. The order of developed colors, in particular, should be decided carefully since it is related with such as the distinctness of the color image and the obtained potential contrast.

After the surface of the photosensitive member 141 with the image thereon developed by the developing device 117Y was recharged by a scorotron corona charging device to the surface potential of +100 V, the same was subjected to a whole surface exposure passed through the green filter. The electrostatic image obtained thereby had −300 V against −0 V at the background portion. The electrostatic image was developed by the developing device 117M under the same conditions as those in the case of the developing device 117Y such that the developing sleeve was applied with the voltage having −50 V of d.c. component and 2.5 kHz, 2000 V of a.c. component.

Similarly, after recharging by a scorotron charging device was applied to the surface of the photosensitive member 141 to the surface potential of +100 V, the same was subjected to a whole surface exposure passed through the red filter. And thereby, an electrostatic image having −250 V against −0 V at the background portion was formed and this static image was developed by the developing device 117C under the same conditions as in the case of the developing device 117Y such that the developing sleeve was applied with the voltage having −50 V of d.c. component and 2.5 kHz, 2000 V of a.c. component.

After the third development was finished and there was formed a three-color image on the photosensitive member 141, a corona charging device 121 and a pre-transfer lamp 122 were activated to make the color image easily transferable and then the image was transferred by a transfer device 109 to copying paper 108, and the same was separated by a separating device 110 and the image was fixed by a heat roller fixing device 113.

The photosensitive member 141, after the transfer of the color image, was treated by a charge eliminating device 111 while receiving irradiation of white light, whereby electricity thereon was removed, and cleared of residual toner on its surface by a cleaning blade of a cleaning device 112, and thus, when the surface on which the image had been formed went through the cleaning device 112, one cycle of the color image recording was completely finished.

The thus recorded color image was a very distinct one free from such fault as mixing with each other of toners of different colors where they were disposed close to each other, not to mention where they were sparsely distributed.

EXPERIMENT 2

Figure 32:
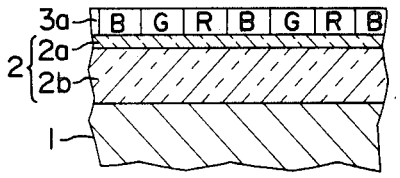

A photosensitive member structured as shown in FIG. 32 was produced using the CGL and CTL materials as shown in Table 2(ii) and FIG. 31(ii), by providing a charge injection layer on an aluminum substrate, disposing a photosensitive layer made up of a CTL layer of a thickness of 25 μm and a CGL layer of a thickness of 1 μm thereover with polyester used as a binder, and further, putting a mosaic filter of a thickness of 20 μ m like that used in the experiment 1 over the same. To compensate for blue sensitivity of the photosensitive member which was insufficient as compared with the Se-Te photosensitive member, a blue color fluorescent lamp was used in addition to a halogen lamp as the image exposure light source. And image formation was conducted under the same conditions as before except that the peripheral speed was set at 50 mm/sec because of lower photosensitivity. The obtained potential contrast was as low as ⅔ of that in the experiment 1, but a good image was formed under similar conditions.

It is a matter of course that the present invention includes not only the above described developing method but also the following methods as variations of the developing method performed without sliding contact with the photosensitive member: the method to make one-component development with a toner in an alternating electric field employing such a technique to take only the toner out of a composite developer onto a developer feeding member (Japanese Patent Laid-open No. 59-42565, Japanese Patent Application No. 58-231434); the method to make development using one-component developer in an alternating electric field with a linear or mesh control electrode provided therein (Japanese Patent Laid-open No. 56-125753); and the method to make development using two-component developer in an alternating electric field with similar control electrode provided therein (Japanese Patent Application No. 58-97973).

In the above described experiments, corona transfer was employed as the transfer method of the toner image but other methods can also be practicable. For example, if adhesive transfer as described in such as Japanese Patent Publication Nos. 46-41679 and 48-22763, transfer is made possible without minding the polarity of the toner. Further, such arrangement is also possible to form the photosensitive member into a layer structure of an insulating layer, photosensitive layer, photoconductive layer, and a filter, and the primary and secondary charging is applied from the side of the insulating layer and the image exposure and whole surface exposure are applied from the side of the filter, and thereby, developing is made from the side of the insulating layer. Besides, while all the above descriptions were of the color copying machines using a three-color separation filter and three primary color toners, embodiments of the present invention are not limited to those but are widely applicable to various multicolor image recording apparatus, color photograph printer, and so on. Combinations of colors of the color separation filter and colors of toners can of course be selected at will depending on purposes. For example, when a process to provide a two-color reproduction is thought of, such an arrangement can be employed in which, as a photosensitive member, that with green (G) filters scatteredly distributed thereon is used and, as the original, that formed of two color portions of red and black is used. Then, as a process fundamentally the same as the process described above (in which, however, the whole surface exposures are performed with G and R, or G and B), there is such a process providing a reproduction in which black portions in the original are reproduced by virtually black portions formed of black toner and red toner and red portions in the original are reproduced by red portions formed of red toner. Therefore, the words "plural kinds of filters" used in the present specification includes such a case where a photosensitive member having a layer with a single color filter portion and a portion with no color filter (which may be formed of transparent resin or air) provided therein, because the portion with no color filter is considered to be a transparent filter portion.

Further, the word "charging" in this specification includes the case where "charging" is applied to a surface, and thereby, the surface potential is turned to zero or the charges on the surface are erased.

Besides, in the above description, the spectral characteristics for the specific light for the whole surface exposures were of the same colors as those of the filter of the photosensitive member, green (G), blue (B), and red (R), the spectral characteristics need not be limited to G, B, and R. The point is that the spectral characteristic is to be such that will produce, by the whole surface exposure by the specific light, a potential pattern only at the portion of specific filter (not always of one kind). For example, when a potential pattern is formed on the blue filter, there is such an instance that the whole surface exposure is made by the light having such a broad spectral characteristic, that is, below approximately 500 nm and yet including wavelengths below 400 nm.

As described so far, the image forming apparatus according to the present embodiment of the invention is structured such that primary charging means, secondary charging means, image exposure means, tertiary charging means, and whole surface exposure means by specific color of light are arranged in succession opposite to a photosensitive member having more than two spectral sensitivities, the obtained image is free from faults such as shear in the colors and has high faithfulness in image reproduction. Further, since the image exposure means and charging means can be separately disposed, there is no restriction as to selection of the materials for the photoconductive layer such that a material providing fast transfer speed for holes or electrons must be used, and therefore, there is high freedom in the selection. And there is no complexity in designing the image exposure means and charging means.

A further embodiment of the present invention will be described in the following.

Figure 34:
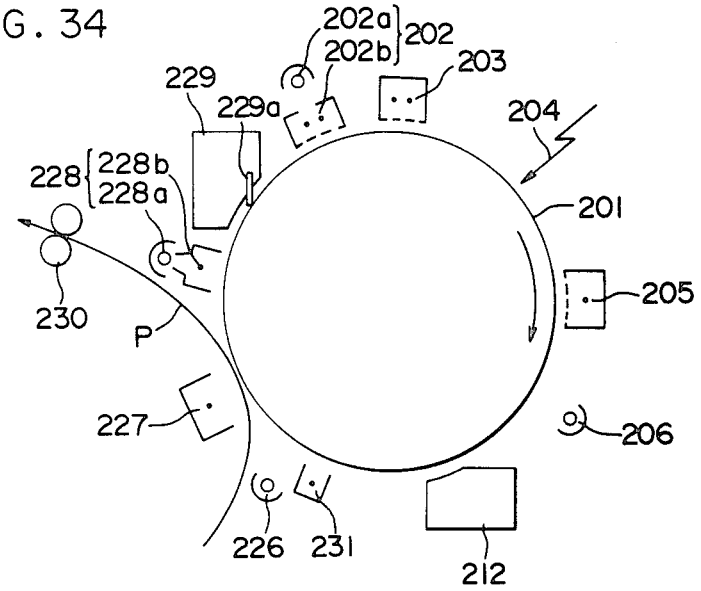
Figure 35:
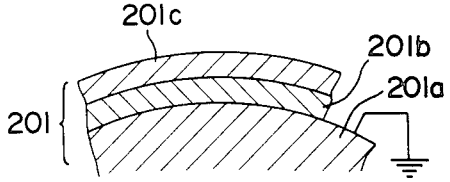

Referring to a recording apparatus of FIG. 34, 201 denotes an image retainer (photosensitive member) in a drum form rotating in the direction as indicated by the arrow, and the photosensitive member 201 is, as shown in FIG. 35, made up of a conductive substrate 201*a* of aluminum, nickel, or the like with a photoconductive photosensitive layer 201*b* of Se, CdS, Si, or the like disposed thereon, and with a transparent insulating surface layer 201*c* of transparent resin or the like disposed over the same, wherein the conductive substrate 201*a* is grounded. Reference numeral 202 denotes a primary charging device formed of a combination of a lamp 202*a* for irradiating the surface of the photosensitive member 201 and a corona discharging device 202*b*, 203 denotes a secondary charging device formed of a corona discharging device, and 204 denotes image exposure. Here, the primary charging device 202 need not necessarily be including the lamp 202*a* if the photoconductive photosensitive layer 201*b* of the photosensitive member 201 is such that has a semiconductor characteristic to exhibit the rectifying action enabling injection of electric charges from the substrate 201*a*. The image exposure 204 disposed against the drum-formed photosensitive member 201 is like the one making a slit exposure practiced in ordinary electrophotographic copying machines. The image exposure 204, however, is not limited to such a slit exposure, but may be such that is obtained by the use of laser, LED, CRT, liquid crystal, or optical fiber transmitting member. If the image retainer can be made in a planer form, such as a belt form, it can be a flash exposure. Reference numeral 205 denotes a tertiary charging device of similar construction to the secondary charging device 203 for flattening the surface potential on the photosensitive member 201 produced by the image exposure 204. Numeral reference 206 is a lamp for whole surface exposure for providing the whole surface exposure to form a potential pattern (secondary electrostatic latent image) on the surface of the photosensitive member 201.

Reference numeral 212 in FIG. 34 is a developing device using toners of chromatic colors such as blue and red or black color as a constituent of its developer and as the developing device, such as structured as shown in FIG. 19 or FIG. 23 is preferably used.

Reference numeral 226 in FIG. 34 denotes a pretransfer lamp for irradiating the surface of a photosensitive member 201 after development and before transfer, 231 denotes a corona discharging device charging the toner likewise prior to the transfer, 227 denotes a transfer device formed of a corona discharging device, 228 denotes a charge eliminating device made up of either one or both of a lamp 228*a* for irradiating the surface of the photosensitive member 201 and a corona discharging device 228*b*, 229 denotes a cleaning device disposed opposite to the surface of the photosensitive member 201 for removing residual toner on the photosensitive member 201 by the use of a cleaning blade 229*a*, and 230 denotes a fixing device for fixing a toner image transferred onto a recording member P.

Figure 36:
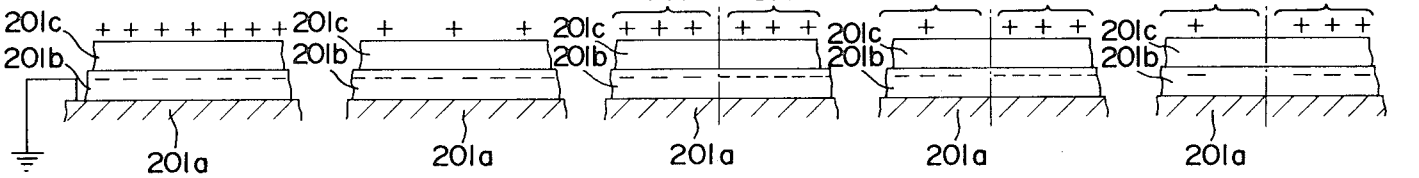

In the recording apparatus arranged as described above, if a corona discharge from the corona discharging device 202*b* is applied to the surface of the photosensitive member 201 while the same is irradiated by the lamp 202*a* of the primary charging device 202 (as previously mentioned, there is a case where the lamp 202*a* is not required), then the photosensitive member 201 comes to have electric charges on the surfaces of the photoconductive photosensitive layer 201*b* and the transparent insulating surface layer 201*c* as shown in FIG. 36(*a*). If the surface of the thus charged photosensitive member 201 is then exposed to a corona discharge from the secondary charging device 203, since the photoconductive photosensitive layer 201*b* has an insulating property, the electric charges on the transparent insulating surface layer 201*c* decrease and the state of the charges in the photosensitive member 201 becomes as shown in FIG. 36(*b*). If the image exposure 204 is then introduced to irradiate the surface of the photosensitive member 201 provided with the secondary charges as above, the surface charges on the photoconductive photosensitive layer 201*b* at the exposed portion PH are decreased, while the charges at the unexposed portion DA remain intact, and the state of the charges in the photosensitive member 201 becomes as shown in FIG. 36(*c*). Then, a corona discharge from the tertiary charging device 205 is applied to smooth the surface potential on the photosensitive member 201 (FIG. 36(*d*)), and in succession thereto, a whole surface exposure by the exposure lamp 206 is performed, and thereby, the charges on the photoconductive photosensitive layer 201*b* at the unexposed portion DA are erased (FIG. 36(*e*)).

Figure 37:
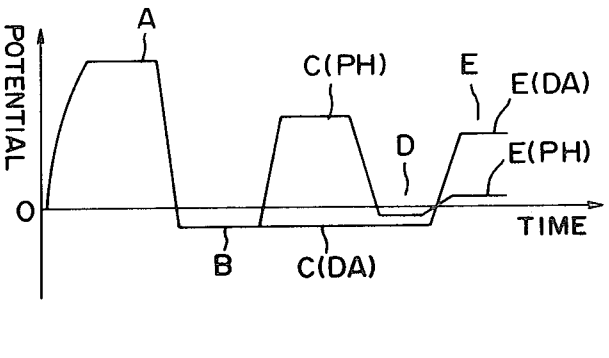
Figure 37:
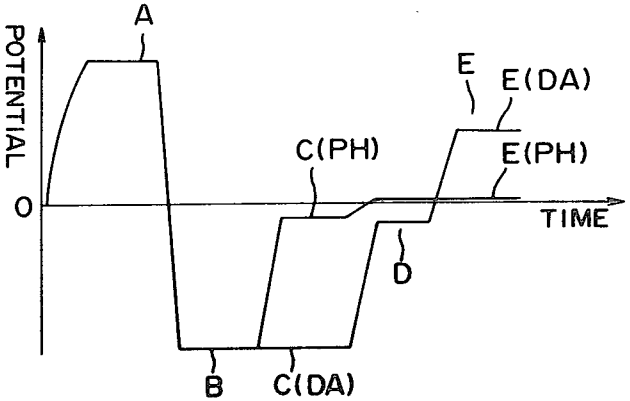

The changes of the surface potential on the photosensitive member 201 in the above described course are shown in FIG. 37(*a*). The states of potential as denoted by A, B, C, D, and E in FIG. 37(*a*) correspond to the states of charges in FIGS. 36(*a*), 36(*b*), 36(*c*), 36(*d*) and 36(*e*), respectively. That is, the potential at the exposed portion PH subjected to the image exposure 204 is brought to the surface potential level as indicated by E(PH) in FIG. 37(*a*), which is virtually on the same level as the surface potential indicated by B in FIG. 37(*a*), and against this background potential, the unexposed portion DA to the image exposure 204 becomes to have an electrostatic latent image of the surface potential as indicated by E(DA). In the same way as in an ordinary electrophotographic copying machine, the electrostatic latent image can be processed by normal development with a developer charged oppositely to the polarity of the latent image to develop the unexposed portion DA. In the above described system, the potential of the electrostatic latent image can be controlled by regulating relative strength between the primary, secondary, and tertiary charging so that the exposed portion and the unexposed portion may be brought into the same or opposite polarities. But, for the ease of development, it is preferred that the white ground potential of the exposed portion is brought to approximately zero level. By making the white ground level approximately zero, the d.c. bias to be applied to the developer feeding member at the time of development can be set at a low value, and thereby, the possibility of the toner attaching to the white ground and causing a fog can be eliminated.

Figure 38:
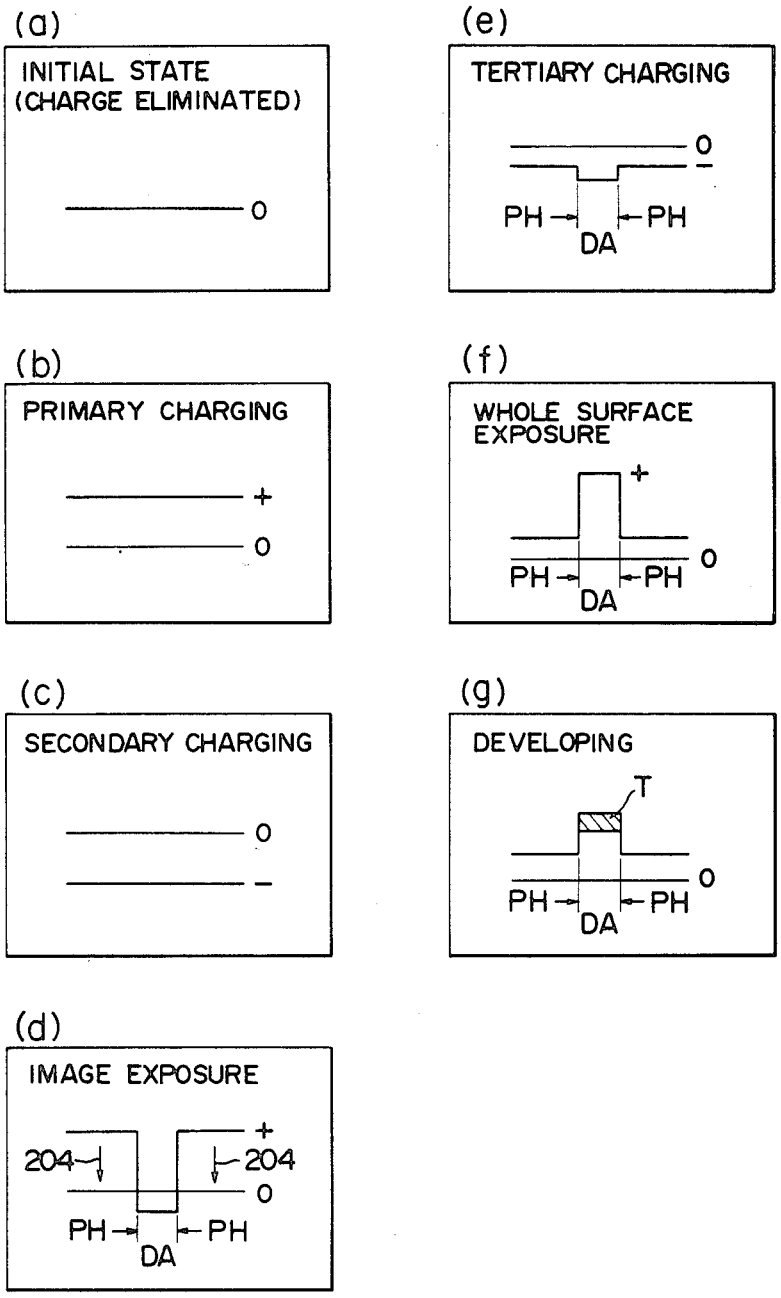

FIG. 38 is a diagram showing flow of the above described normal image forming process in which a latent image is formed by the unexposed portion DA made into an electrostatic latent image with the exposed portion made into the background and the latent image is developed with the toner charged equally to the polarity of the background portion.

According to the image forming apparatus of FIG. 34, the surface of the photosensitive member 201 in the initial state (a), i.e., cleared of electricity by the charge eliminating device 213, cleaned by the cleaning device 214, and held at zero potential, is uniformly charged (b) by the primary charging device 202. Then, subjected to the discharge from the secondary charging device 203 of the opposite polarity to the primary charging, the surface potential of the photosensitive member 201 is brought to virtually zero (slightly negative) (c). Then, subjected to the image exposure 204, the potential at the exposed portion PH is elevated (d), and thereafter, subjected to the discharge from the tertiary charging device 205, the potential at the exposed portion PH is lowered and smoothed (e). Then, subjected to the whole surface exposure by the exposure lamp 206, the potential at the unexposed portion DA is elevated (f), and thereafter, the toner T of the opposite polarity to the potential at the unexposed portion DA is attached to the unexposed portion DA (g) by the developing device 212. Thus, a normal image is formed by the attaching of the toner to be unexposed portion DA, and the normal picture image is recorded on recording paper P through the steps of transfer 227 and fixing 230.

In the above described method, some change is produced in the potential at the white ground portion E(PH) by the whole surface exposure, and this makes the white ground potential unstable, slightly as it is. And so, instead of the application of the recharging to the white ground portion C(PH) in the above described method, the black ground potential can be recharged and brought to the level of the white ground potential so that the white ground potential E(PH) may not be changed if subjected to the whole surface exposure. FIG. 37(*b*) showing this method is different from FIG. 37(*a*) in that it is therein adapted such that the unexposed portion C(DA) is chiefly deprived of its electricity at the tertiary charging, whereas the exposed portion C(PH) is substantially kept from being charged. By so doing, the potential at the exposed portion E(PH) is made stabler.

The case where a reverse image is formed will be described in the following.

The reverse image can be formed by leaving out only the steps of charging by the tertiary charging device 205 and the whole surface exposure by the exposure lamp 206. That is, the exposed portion (PH) in the state of FIG. 36(*c*) is subjected to development (reverse development). Since the electrostatic latent image in FIG. 36(*c*), namely, the direction of the electric field in the electrostatic latent image C in FIG. 37(*a*) or FIG. 37(*b*) is the same as that of the above described electrostatic latent image denoted by FIG. 37(*e*) in the same drawings, it can be developed by the same developer used for the electrostatic latent image denoted by FIG. 37(*e*). However, since the potential contrasts (C(PH)-C(DA)) and the background potential in FIG. 37(*a*) and FIG. 37(*b*) are different from those in the above described normal development, (E(DA)-E(PH)) and E(PH), the developing bias must be controlled accordingly.

Figure 39:
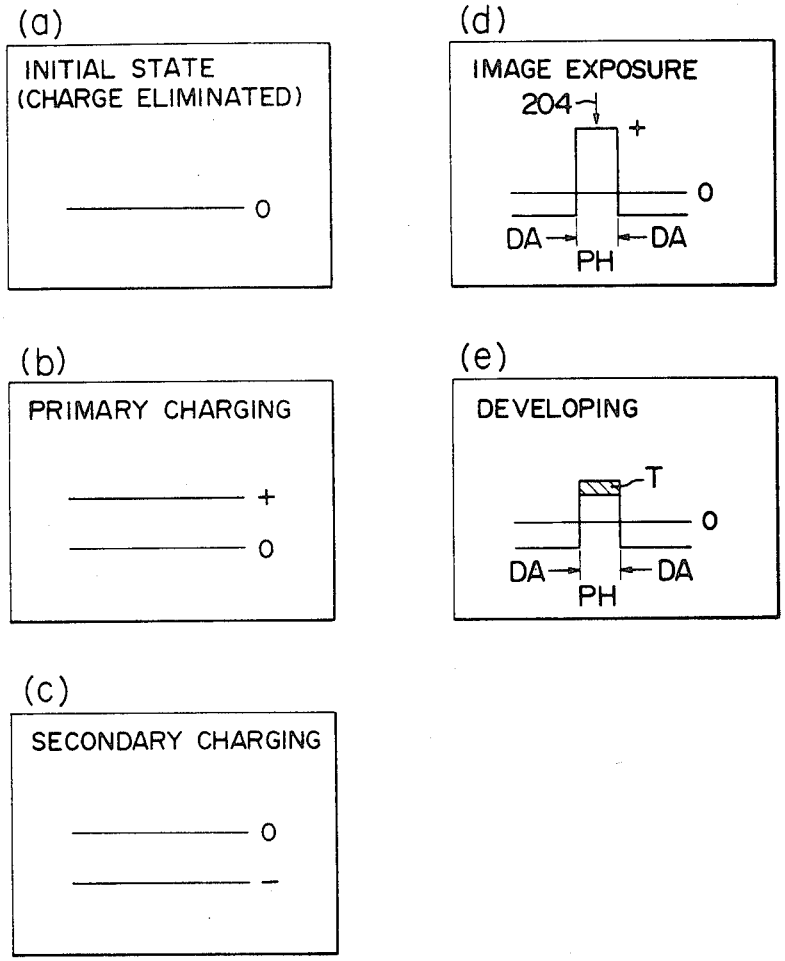

FIG. 39 is diagram showing the flow of the above described inverse picture image forming process in which a latent image is formed by the image forming method such that the exposed portion PH becomes the portion to which the toner is attached and the unexposed portion becomes the background portion and the development is performed with the toner charged oppositely to the polarity of the exposed portion.

States up to the secondary charging step are the same as in the above described states in FIG. 38. The state (d) of the surface potential on the photosensitive member 201 in FIG. 39 is the same as that (d) in FIG. 38. (In FIG. 39, the position of the exposed portion PH and that of the unexposed portion DA are shown reversely to those in FIG. 38.) After a latent image has been formed by the image exposure 204 as shown in (d) of FIG. 39, the reverse development (e) is performed by the developing device 212 by attaching the toner T of the opposite polarity to the exposed portion PH onto the exposed portion PH. Thereafter, the reverse image is recorded in recording paper P through steps of transfer and fixing in the same way as described above.

According to the present embodiment of the invention as described above, either of normal development and reverse development can be easily selected and practiced by using the same developing device.

The above embodiment will be described in detail according to concrete experiments 3 and 4 in the following.

EXPERIMENT 3

(The case of FIG. 38.)

The image forming apparatus as shown in FIG. 34 was used, wherein the photosensitive member 201 was formed of a CdS photosensitive layer of a thickness of 30 μm with a transparent insulating layer of a thickness of 20 μm disposed thereon and the peripheral speed of the same was set at 180 mm/sec. The photosensitive member 201 was charged by the scorotron d.c. corona discharging device **202*b* while being subjected to a uniform exposure by the lamp 202*a* of the primary charging device 202 so that the surface potential of the photosensitive member 201 became +1500 V. Then, a charge was applied by the secondary charging device 203 formed of a scorotron corona discharging device having an a.c. component so that the surface potential on the photosensitive member 201 became 0 V. An image exposure of a scanned original was applied to the above charged surface, whereby an electrostatic image was formed of which the potential at the exposed portion was 700 V against the 0 V potential at the exposed portion. After a corona discharge from the tertiary charging device 205 formed of a scorotron corona discharging device was applied, whereby both the exposed and unexposed portions were brought to the potential level of approximately −100 V, a whole surface exposure was applied by the exposure lamp 206. At this time, the surface potential on the photosensitive member 201 was +50 V at the exposed portion and +600 V at the unexposed portion. The latent image was developed by the previously mentioned developing device 212**.

In the developing device 212, a developer made up of such a carrier that is formed of a resin containing 70% by weight of magnetite dispersed therein, 30 μm in average particle size, 30 emu/g in magnetization, and $10^{14}$ Ωcm or higher in resistivity and such a non-magnetic toner that is formed of styreneacrylic resin added with carbon black of a percentage of 5 by weight and, further, with a charge controlling agent, and 10 μm in average particle size, in the mixture ratio of the toner to the carrier being 20% by weight. It was also arranged such that the outer diameter of the developing sleeve was 30 mm, its number of revolutions was 100 rpm, the magnetic flux density of the poles N and S of the magnet member was 900 gauss, its number of revolutions was 1000 rpm, the thickness of the developer layer in the developing region was 0.6 mm, and the gap between the developing sleeve and the image retainer 201 was 0.8 mm, and a non-contact jumping developing system was employed with the developing sleeve applied with a superimposed voltage of 150 V of d.c. voltage and 1.5 kHz, 1500 V of a.c. voltage.

Further, while the developing device 212 was not developing an electrostatic image, the same was disabled to develop. This is achieved by cutting off the developing sleeve from the power sources to put it in a floating state, grounding the same, or, positively, by applying the developing sleeve with a d.c. bias voltage of the same polarity as the electrostatic image, i.e., the opposite polarity to the charges on the toner, out of which the application of the d.c. voltage is preferable.

After the above development was finished and a toner image was formed on the image retainer 201, either or both of the corona discharging device 231 and the pre-transfer lamp 226 according to the need were activated so that the toner image may be easily transferred, and then the image was transferred to a recording member P, and fixed by the fixing device 230.

The photosensitive member 201 after the transfer of the toner image therefrom was treated by the charge eliminating device 228 so that its electricity was eliminated and then cleared of residual toner on its surface by the cleaning blade **229*a* of the cleaning device 229, and when the surface on which the image had been formed passed the cleaning device 229**, one cycle of the image recording process was completely finished.

The image recorded through the above described process was completely free from a fog and very distinct, and the picture were stable throughout the course of repeated recording.

EXPERIMENT 4

(The case of FIG. 39)

The recording apparatus of the same type as was used in the previous experiment 3 and capable of forming a reversal image was used. By depressing a reversal key on the control panel, the following operations were started. That is, the primary charging and secondary charging were performed by the primary charging device 202 and the secondary charging device 203 under the same conditions as in the experiment 3. And after the image exposure only was made, an electrostatic image of which the potential at the exposed portion was +700 V against 0 V potential at the background portion was formed on the photosensitive member 201 arranged on the same conditions as in the experiment 3. Namely, in the reversal mode, the tertiary charging and the whole surface exposure are not practiced.

The electrostatic image was developed by the developing device 212 under the same conditions as in the experiment 3 except that the developing sleeve was applied with a superimposed voltage of d.c. voltage of 100 V and a.c. voltage of 1.5 kHz and 1000 V. The obtained image was a reversal image of that obtained in the experiment 3.

In the developing in these experiments, the image density can be adjusted by properly varying the d.c. bias component and amplitude, frequency, duty ratio, etc. of the a.c. component of the voltage applied to the developing sleeve 216 according to the changes in the surface potential on the photosensitive member 201 and developing characteristics.

Further, the image forming apparatus according to the present embodiment of the invention can be advantageously applied to the system that makes a dot exposure by using such as laser, LCS, and LED light source as the image exposure at the time of reversal image formation. In using the apparatus of FIG. 34, if a dot exposure apparatus is used with the copying machine light source, an advantage is obtained that one and the same developing device can be used for development.

As described in the foregoing, the image forming apparatus according to the present invention is structured such that the primary charging means, secondary charging means, image exposure means, tertiary charging means, whole surface exposure means, and developing means for making normal development of an electrostatic latent image formed by the whole surface exposure means are disposed in succession opposing the photosensitive member, and therefore, the charging means (i.e., the primary and secondary charging means) and the image exposure means can be separately disposed, and so, it is made possible to avoid difficulty in the designing. And, since the image exposure simultaneously performed with the charging is not practiced, materials providing slower transfer speeds for electrons or holes such as organic materials, for example, can be used as the materials of the photoconductive layers, and therefore, a constraint in designing is removed. Further, since use or disuse of the tertiary charging means and the whole surface exposure means can be freely selected, either normal development or reversal development can be simply selected for desired image formation.

What is claimed is:

1. An image forming apparatus comprising a photosensitive member having a photoconductive layer, an insulating layer, and a differently colored fine filter layer, a charger for uniformly charging said photosensitive layer, means for exposing an image, at least two developing means, means for flattening the potential of the surface of said photosensitive member after an image exposure by said means for exposing, said means for flattening being placed between said means for exposing and said developing means, means for uniformly exposing said photosensitive member by using one of said at least two colors, said means for uniformly exposing being placed between said means for flattening and said developing means.

2. The apparatus of claim 1 wherein said insulating layer is on the surface of said photosensitive layer.

3. The apparatus of claim 1 wherein at least one of said developing means comprises a developer which is not in contact with said photosensitive layer, said developing means also including a means for flying toner.

4. The apparatus of claim 3 wherein said means for flying toner comprises an a.c. field generating means.

5. A method of forming an image of at least two colors comprising uniformly charging a photosensitive layer, then imagewise exposing said layer, then flattening the potential of the surface of said layer, then uniformly exposing said layer to light of one of said colors to form a first latent image, then developing said first image, then flattening the potential of said surface of said layer, then uniformly exposing said layer to light of another of said colors to form a second latent image, and then developing said second latent image.

6. The method of claim 5 wherein at least one developing comprises flying toner across a gap between a developer and said layer.

* * * * *